US009739584B2

(12) United States Patent
Chua et al.

(10) Patent No.: US 9,739,584 B2
(45) Date of Patent: Aug. 22, 2017

(54) PROJECTILE TRACER

(71) Applicant: Physical Optics Corporation, Torrance, CA (US)

(72) Inventors: Kang-Bin Chua, Torrance, CA (US); Ranjit Pradhan, Torrance, CA (US); Jerald A. Cole, Long Beach, CA (US); Gibum Kim, Fullerton, CA (US); Joseph Rustick, Phoenix, AZ (US)

(73) Assignee: Physics Optics Corporation, Torrance, CA (US)

( * ) Notice: Subject to any disclaimer, the term of this patent is extended or adjusted under 35 U.S.C. 154(b) by 0 days.

(21) Appl. No.: 14/451,231

(22) Filed: Aug. 4, 2014

(65) Prior Publication Data

US 2015/0308802 A1 Oct. 29, 2015

Related U.S. Application Data

(60) Provisional application No. 61/983,866, filed on Apr. 24, 2014, provisional application No. 61/992,782, filed on May 13, 2014, provisional application No. 62/014,022, filed on Jun. 18, 2014, provisional application No. 62/014,937, filed on Jun. 20, 2014.

(51) Int. Cl.
*F42B 12/38* (2006.01)
*B02C 19/18* (2006.01)

(52) U.S. Cl.
CPC ..... *F42B 12/38* (2013.01); *B02C 19/18* (2013.01); *F42B 12/382* (2013.01)

(58) Field of Classification Search
CPC ..... F42B 12/38; F42B 12/382; B02C 19/18; C06B 12/00; C06B 12/0033; C06B 12/0066
USPC ..... 102/513, 529, 283, 292; 86/1.1; 241/1
See application file for complete search history.

(56) References Cited

U.S. PATENT DOCUMENTS 4,131,238 A * 12/1978 Tarpley, Jr. ..... B02C 19/18 241/1
5,439,537 A * 8/1995 Hinshaw ..... C06D 5/06 149/22
5,731,540 A * 3/1998 Flanigan ..... B01J 2/10 149/109.6
8,231,748 B1 * 7/2012 Higa ..... C06B 21/0066 149/108.2
8,257,523 B1 * 9/2012 Puszynski ..... C06B 21/0008 149/108.2
2006/0113014 A1 * 6/2006 Puszynski ..... C06B 21/0008 149/40
2010/0032064 A1 * 2/2010 Dreizin ..... C06B 21/0066 149/37
2010/0279102 A1 * 11/2010 Gangopadhyay ..... B22F 1/0022 428/317.9
2011/0265914 A1 * 11/2011 Reuther ..... B23K 31/10 148/199

* cited by examiner

*Primary Examiner* — Bret Hayes
(74) *Attorney, Agent, or Firm* — Sheppard, Mullin, Richter & Hampton LLP; Daniel Yannuzzi

(57) ABSTRACT

Tracer ammunition is disclosed and includes a projectile having a body; a chamber in the body having a front end and a rear end, the rear end of the chamber being open; an aperture at a rear end of the body providing an opening to the open end of the chamber; and a tracer material disposed within the chamber, wherein the tracer material is configured to combust when ignited and emit optical energy through the aperture as a result of the combustion process. The tracer material may be configured to include a rear-facing surface having a concave contour to aid in directivity of light output from the tracer material.

12 Claims, 23 Drawing Sheets

PROJECTILE TRACER

CROSS-REFERENCE TO RELATED APPLICATIONS

This application claims the benefit of U.S. Provisional Application Nos. 61/983,866, filed on Apr. 24, 2014; and 61/992,782, filed on May 13, 2014; and 62/014,022, filed on Jun. 18, 2014; and 62/014,937, filed on Jun. 20, 2014, each of which are hereby incorporated herein by reference in their entirety.

STATEMENT OF RIGHTS TO INVENTIONS MADE UNDER FEDERALLY SPONSORED RESEARCH

This invention was made with Government support under contract numbers W15QKN-11-C-0040 and W15QKN-12-C-0015, both titled "Rearward Emitting Tracer Ammunition," awarded by the U.S. Army. The Government has certain rights in the invention.

TECHNICAL FIELD

The disclosed technology relates generally to tracers for ammunition, and more particularly, some embodiments relate to tracers visible only in the direction of the shooter.

DESCRIPTION OF THE RELATED ART

Tracer ammunition includes bullets and other projectiles that include a mechanism to provide a visible artifact enabling the shooter to see the path of the ammunition upon firing. Tracer ammunition may include a small pyrotechnic charge built into the base. This charge can be ignited by the burning powder, and, once ignited, burns very brightly enough to be visible to the naked eye. The tracer allows the shooter to see the projectile trajectory and make aiming corrections as necessary.

Conventional tracer ammunition suffers from the disadvantage of being visible not only to the shooter but also to others, including potentially the target or enemies. This allows the enemy to identify the source of the gunfire and to return fire to the shooter. Conventional tracer ammunition also suffers from the disadvantage that as the pyrotechnic charge burns, the mass of the projectile changes, and, as a result, the tracer does not always follow the same trajectory as non-tracer projectiles.

Subdued tracers attempt to alleviate these disadvantages by including an ignition delay. However, even with an ignition delay they can still provide unwanted trajectory information to the enemy. With sufficient trajectory information, the enemy may still be able to make a reasonable guess as to the location of the shooter. In addition, neither conventional nor conventional subdued tracers are compatible with night vision goggles. They can generally overload the goggles, causing a bloom in the field of vision that effectively blinds the user.

Dim tracers can be used to not overwhelm the night vision goggles by emitting a lesser amount of light. However, such tracers typically emit mainly in the infrared (IR) spectrum, and therefore are not visible in daylight or at night without night vision goggles. Also, because they can be seen at night with night vision goggles, dim tracers may also be seen by the enemy with IR vision equipment.

Other recent concepts embed a battery- or capacitor-powered LED in the rear of the projecting, but these have issues with long term reliability, ruggedization, and operability over the entire (>1 km) range of the tracer projectile.

BRIEF SUMMARY OF EMBODIMENTS

Embodiments of the technology disclosed herein are directed toward devices and methods for providing tracer ammunition. More particularly, certain various embodiments of the technology disclosed herein relate to ammunition providing a tracer that is visible only in the direction of the shooter. Embodiments also disclose methods of manufacturing tracer materials and tracer ammunition.

in various embodiments, tracer ammunition according to the technology disclosed herein can be provided that is perceptible only to the shooter, and to other personnel or equipment in close proximity to the shooter. This can be accomplished using a rearward facing tracer materials. The tracer material can be further designed to provide a vaporless, smokeless reaction to avoid scattering of the optical energy emitted by the tracer material. Such scattering could make the tracer visible in directions other than toward the shooter potentially exposing the trajectory to enemy forces.

Tracer materials can be selected to produce optical energy in both the visible wavelengths as well as infrared wavelengths to allow detectability by the unaided human eye as well as by optical sensing equipment. In further embodiments, the selected materials can be engineered to produce visible emissions and infrared missions at different emissivities to allow compatibility for human viewing with and without night-vision devices. For example, it may be desirable to provide high emissivities for visible emissions during daylight while providing low emissivities for infrared wavelengths to avoid overloading night-vision devices.

Tracer materials can be further engineered to provide differentiability between tracers. Accordingly, through the use of materials that provide specific visible wavelengths, the tracers can be used to differentiate shooters, weapons, ammunition types, or other units. Also, by selecting appropriate tracer materials and providing an adequate seal for the tracer materials, the mass of the tracer materials can remain constant or substantially constant throughout the entire trajectory of the projectile. Thus, the trajectory, lethality, and range of the projectile can be unaffected by what would otherwise be the loss of mass of the projectile due to the combustion process of the pyrotechnic charge. It is noted that in all applications, the mass of the projectile need not remain identically constant, but some loss in mass can be tolerated while still providing an acceptable range, lethality, and predictable trajectory for the intended application.

According to various embodiments of the disclosed technology tracer ammunition is disclosed and includes a projectile having a body; a chamber in the body having a front end and a rear end, the rear end of the chamber being open; an aperture at a rear end of the body providing an opening to the open end of the chamber; and a tracer material disposed within the chamber, wherein the tracer material is configured to combust when ignited and emit optical energy through the aperture as a result of the combustion process. The combustion can occur in a smokeless mass-preserving manner, or a substantially smokeless mass-preserving manner. The tracer material may be configured to include a rear-facing surface having a concave contour to aid in directivity of light output from the tracer material.

In various embodiments, the tracer material can include a rear facing surface having a contour shaped such that the optical energy is emitted as a Lambertian or near Lambertian light source as a result of combustion of the tracer material.

In further embodiments, the surface can be shaped to confine an exit angle of the optical energy to a predetermined maximum angle. In still further embodiments, the surface can be shaped to reduce an axial normal area of the surface relative to a flat surface.

The tracer material may, in various embodiments, include an exothermic material; and a luminescent material disposed on the exothermic material configured to emit optical energy in response to heat generated by the exothermic material. A layer of light scattering material can be disposed on the luminescent material. The luminescent material can be configured to be sufficiently dense to prevent ejecta of exothermic material during projectile flight.

In further embodiments, a dopant can be included to cause the light emitting material to emit light at a predetermined wavelength upon heating the exothermic material to impart a signature to the tracer ammunition.

The tracer ammunition can further include a casing; powder disposed within the casing; and a primer disposed at a rearward end of the casing; wherein the projectile is at least partially disposed within the casing. In still further embodiments, The tracer ammunition further includes a barrier material disposed between the exothermic material and the luminescent material. The barrier material may comprises an allotrope of carbon, which can include, for example, a graphite or a thin film diamond.

An example process for preparing material for tracer ammunition, includes the operations of: receiving first particles of exothermic material of a first average size at a first ultrasonic processing station that includes an ultrasonic transducer; applying ultrasonic energy to the particles by the first ultrasonic processing station to break down the received particles of exothermic material into reduced-size particles of a second average size that is smaller than the first average size; and transferring the reduced-size particles into one or more successive ultrasonic processing station, wherein each of the e or more successive ultrasonic processing stations applies ultrasonic energy to particles it receives to further reduce the average size of its received particles.

The process can also include compacting the exothermic material into a pellet under sufficient pressure to prevent the exothermic material from breaking up and ejecting from the tracer ammunition during combustion thereof.

The process can further include compacting a light producing material onto the exothermic material to form a tracer pellet comprising an exothermic layer capped by a luminescent layer. A seal can be provided on the tracer pellet to form a sealed tracer pellet.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Some of the figures included herein illustrate various embodiments of the disclosed technology from different viewing angles. Although the accompanying descriptive text may refer to such views as "top," "bottom" or "side" views, such references are merely descriptive and do not imply or require that the disclosed technology be implemented or used in a particular spatial orientation unless explicitly stated otherwise.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

Embodiments of the technology disclosed herein are directed toward devices and methods for providing tracer ammunition. More particularly, certain various embodiments of the technology disclosed herein relate to ammunition providing a tracer that is visible only in the direction of the shooter. Embodiments also disclose methods of manufacturing tracer materials and tracer ammunition.

Figure 1:
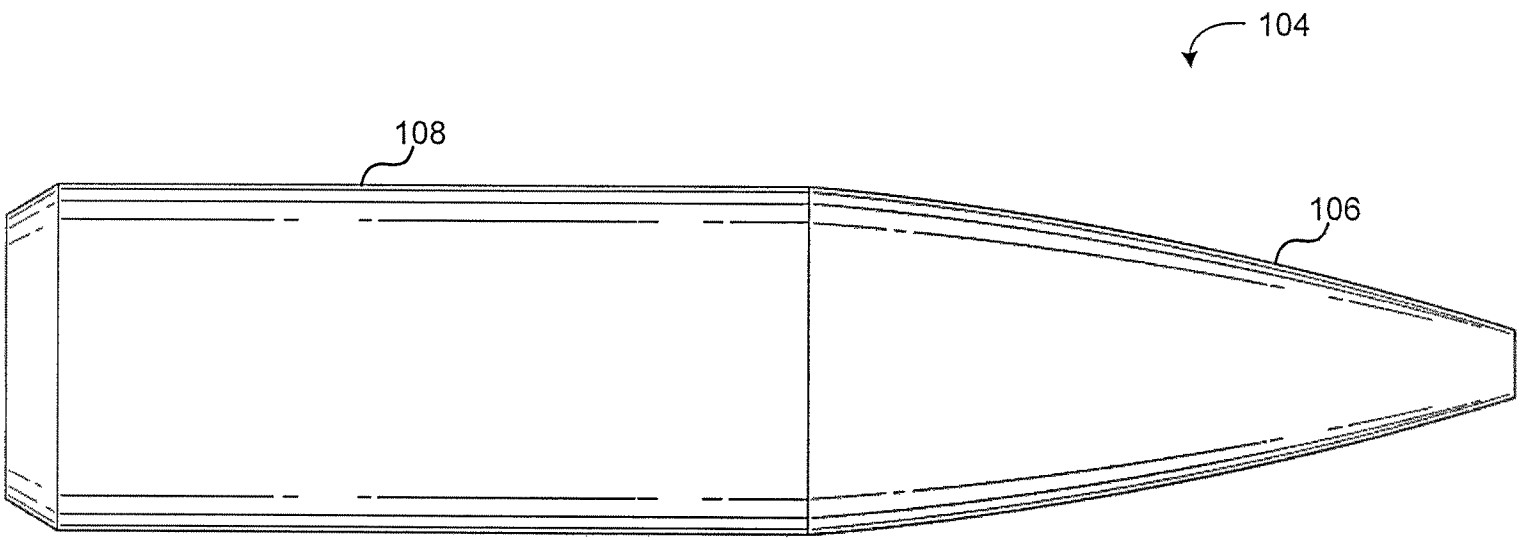
FIG. 1 is a diagram illustrating one example of a projectile with which a visible-only-to-shooter tracer can be implemented.

This technology can be used with any of a number of different types of projectiles including those used as ammunition. This can include for example projectiles ranging from small projectiles used with handguns or rifles, to larger projectiles such as, for example, those used with cannons or heavy artillery. FIG. 1 is a diagram illustrating one example of a projectile with which the tracer can be implemented. The example projectile 104 illustrated in FIG. 1 can be, for example, a bullet or other like projectile. In the case of a bullet, for example, it is typically housed in a casing (not shown). The casing is typically loaded with powder, like a gunpowder, or other explosive to provide the motive force to launch the projectile from a barrel of a gun or other artillery. A primer is typically also included to ignite the powder. The primer can be an explosive compound, which, when impacted by a firing pin, for example, explodes and ignites the gunpowder charge. Igniter configurations for centerfire, rimfire or other cartridges can be used.

In the illustrated example, projectile 104 includes a nose portion 106 and a body portion 108. Although nose portion 106 is illustrated as tapered with a blunt nose, other geometries can be used for projectile 104. As merely examples, pointed soft point, rounded soft point, hollow point and polymer tips can be used. Likewise, although body portion is shown as being of uniform diameter with a taper at the trailing edge, other geometries can be used for body portion 108 of projectile 104. Although not illustrated, projectile 104 can also include a jacket.

The technology is described herein from time to time in the context of example projectile 104. This is done merely to provide context for the tracer technology and is in no way limiting of the applicability of the tracer technology to the example projectile 104. Indeed, after reading the description of the technology included herein, one of ordinary skill in the art will understand how to implement the technology using or other projectiles or artillery in addition to projectile 104.

In various embodiments, the projectile (e.g., projectile 104) can include a hollowed out cavity or open chamber in the body of the projectile. This chamber can be configured to be open to the rear of the projectile. Tracer materials (e.g., pyrotechnic materials) are disposed in the chamber and can be ignited when the projectile is fired from the weapon. As the projectile follows its trajectory, the burning tracer materials emit optical rays (e.g., visible or infrared) in the backward direction of projectile flight. Where the rays are sufficiently confined to be emitted in only the backward direction, the tracer is visible only to the shooter, which can include others in the direction of the shooter relative to the projectile. One way to so confine the rays, is to embed them deeply enough into the chamber such that the walls of the chamber help to confine the rays. Other techniques can also be used to confine the rays, examples of which are further described herein. An example of this includes shaping of the tracer materials within the ammunition.

Figure 2:
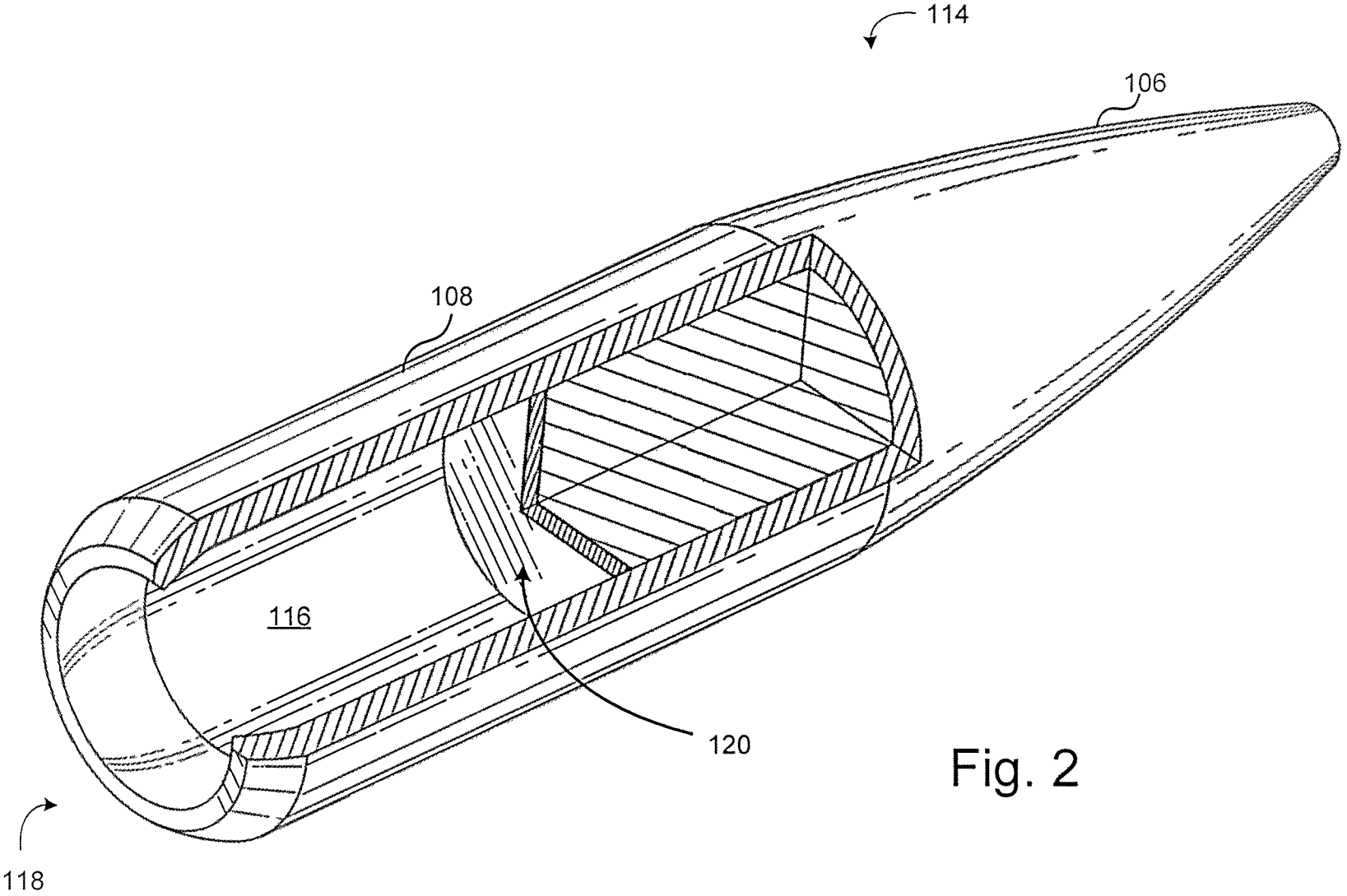
FIG. 2 is a diagram illustrating a cutaway view of an example projectile in accordance with various embodiments of the technology disclosed herein.

FIG. 2 is a diagram illustrating a cutaway view of an example projectile in accordance with various embodiments of the technology disclosed herein. As shown in the cutaway view, the example tracer ammunition 114 includes a chamber 116 in a rearward portion of the body of the projectile. As also seen in this example, chamber 116 is open to the rear of the tracer ammunition 114 by virtue of rearward opening or aperture 118. The boundaries of chamber 116 in this example are defined by forward chamber wall 120 and the inner surface of body portion 108. The proportions in this and other drawings are only exemplary, and other proportions can be utilized. Accordingly, chamber 116 can be larger or smaller relative to the overall size of tracer ammunition 114 or the size of body portion 108. Indeed, chamber 116 can consume the entire interior portion of tracer ammunition 114.

As further shown in this example, the interior of body portion 108 and nose portion 106 can be filled with materials as deemed appropriate for the intended use of the projectile. Alternatively, some or all of the interior of body portion 108 and nose portion 106 can remain hollow, again, depending on the intended use of the projectile.

Figure 3:
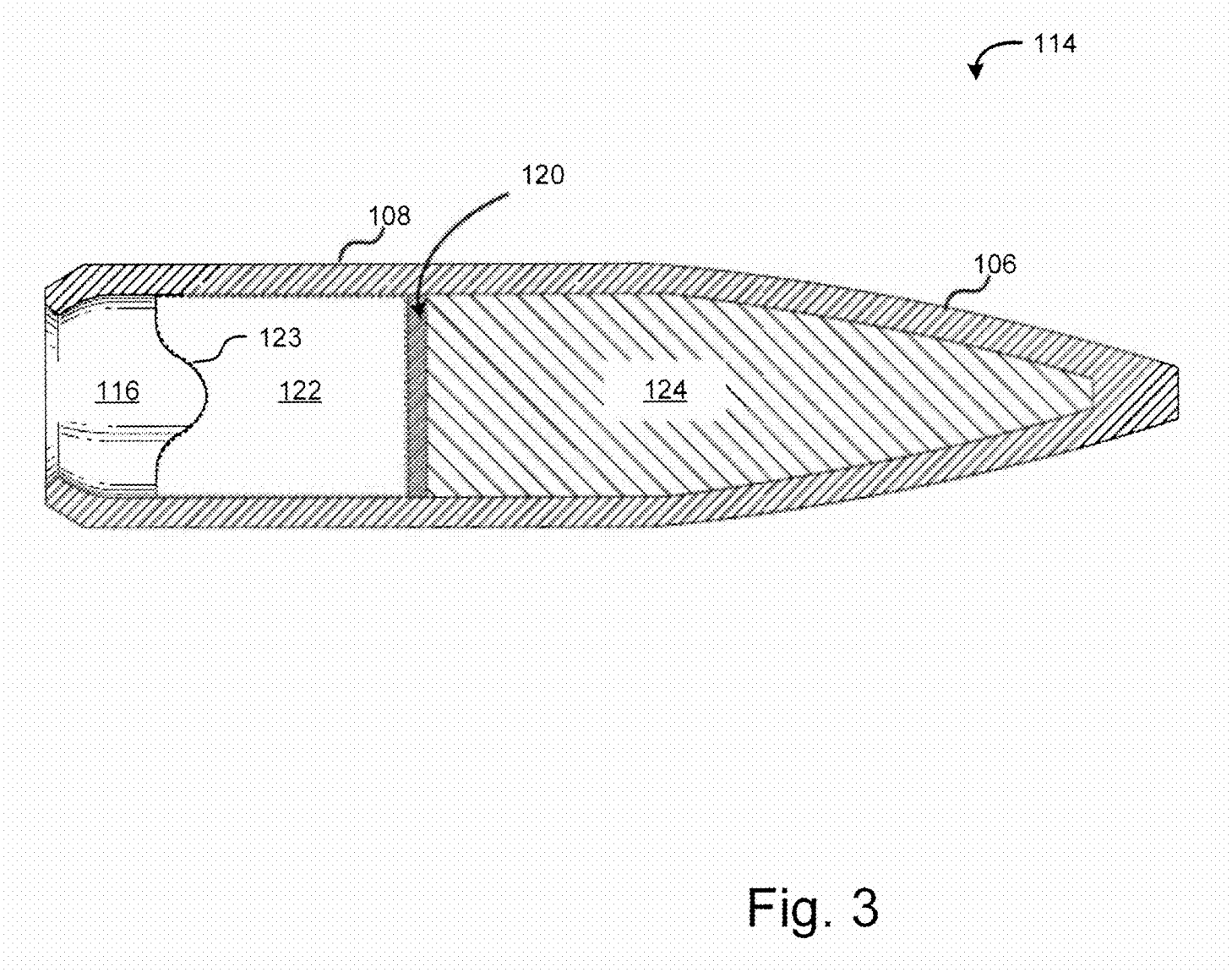
FIG. 3 is a diagram illustrating an example of a projectile including tracer material embedded in a chamber thereof.

FIG. 3 is a diagram illustrating an example of a projectile including tracer material embedded in a cavity thereof. As seen in the example of FIG. 3, tracer ammunition 114 (which can be implemented using, e.g., projectile 104 (FIG. 1)) includes a tracer material 122 within chamber 116. Further in this example, tracer material 122 is packed into the forward region of chamber 116, and the rearward portion of chamber 116 remains open. The depth of packing of tracer material 122 can vary, and greater or lesser amounts of tracer material 122 can be included within chamber 116. This example also shows a forward chamber wall 120 as shown in the previous example of FIG. 2.

Tracer material 122 can comprise an exothermic material or other material that can be ignited, combust, and emit light as a result of the combustion process. Tracer material 122 is packed into chamber 116 in such a way that it has a contoured rear facing surface 123. Rear facing surface 123 need not be contoured in all embodiments, and other embodiments may include a flat surface for rear facing surface 123 or a surface of different contour. Because tracer material 122 is packed into the forward region of chamber 116, the chamber walls at the rearward portion of chamber 116 help to confine the optical energy emitted by the burning tracer material 122. Selection of a contour for rear facing surface 123 can also help to confine the direction of the optical energy emitted by tracer material 122.

This example further shows that the nose portion 106 and the forward portion of body portion 108 are filled with a desired packing material 124 for the ammunition. For clarification only, whether packing material 124 is provided in the projectile and, if so, the type of packing material, is not critical to the tracer but may generally be more important to performance of the ammunition for its intended purpose.

Figure 4:
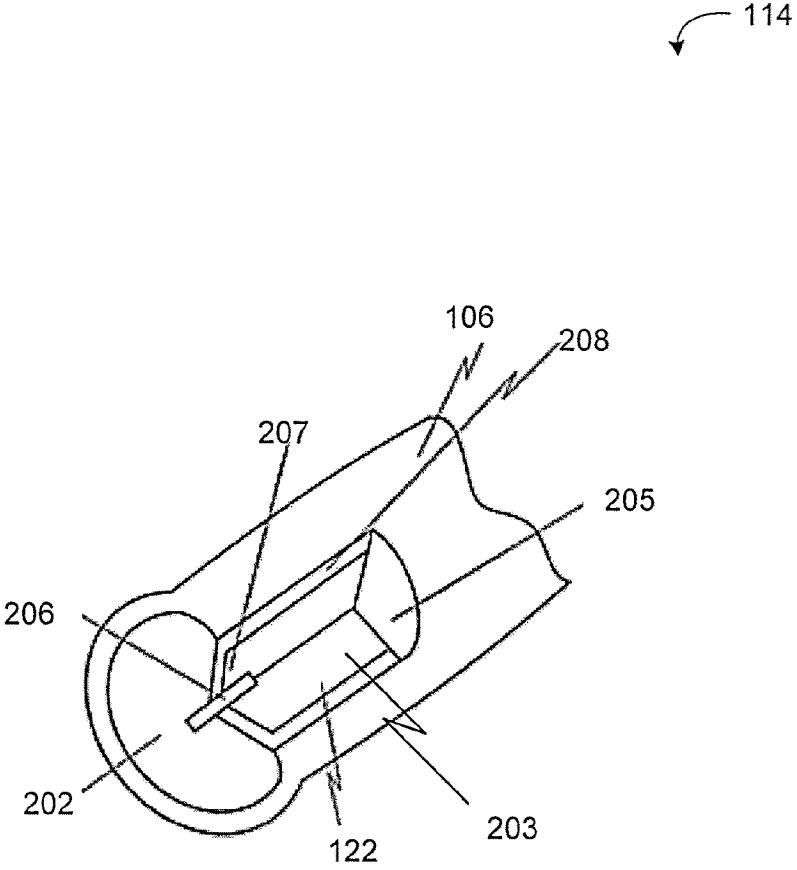
FIG. 4 is a diagram illustrating another example embodiment of a visible-only-to-shooter tracer ammunition.

FIG. 4 is a diagram illustrating another embodiment of a visible-only-to-shooter tracer ammunition. In this example, tracer material 122 of the tracer ammunition 114 (only the rear portion of which is shown) includes a luminescent disk 202, exothermic materials 203, and igniter material 206. Luminescent disk 202 is provided at the rearward portion of the tracer ammunition 114. Luminescent disk 202 can be positioned adjacent to exothermic material 203 (which, in some embodiments can comprise one region or layer of tracer material 122, although layers are not differentiated in the example shown in FIG. 4) within the tracer projectile chamber 116.

An igniter material 206 such as, for example, a magnesium or other like fuse, can be disposed partially within exothermic material 203 extending through luminescent disk 202. Igniter material 206 can be used to ignite exothermic material 203, which, when ignited, thereby causing luminescent disk 202 to emit optical energy used for the tracer. Luminescent disk 202 can be implemented as a candoluminescent ceramic disk, or it can be implemented using glass exothermic materials (e.g., thermites, intermetallics, etc., or other materials) suitable for emitting optical energy. In various embodiments, the luminescent disk 202 emits optical energy as a result of the heat provided by the exothermic reaction of the exothermic materials 203.

This example also includes supportive material 207 such as, for example, a supportive graphite paper that can be included to prevent contaminants, such as contaminants from luminescent disk 202 from being drawn into the exothermic reaction of tracer material 122 while still allowing sufficient heat transfer for the luminescence of luminescent disk 202. Accordingly, supportive material 207 preferably exhibits high thermal conductivity. Also, an insulating material 208 such as, for example, magnesium oxide can be provided on the interior of the walls of the projectile to maintain heat within the chamber to facilitate the exothermic process. Not only can this be used prevent heat loss, but it can also prevent melting or igniting the projectile during flight.

Figure 5:
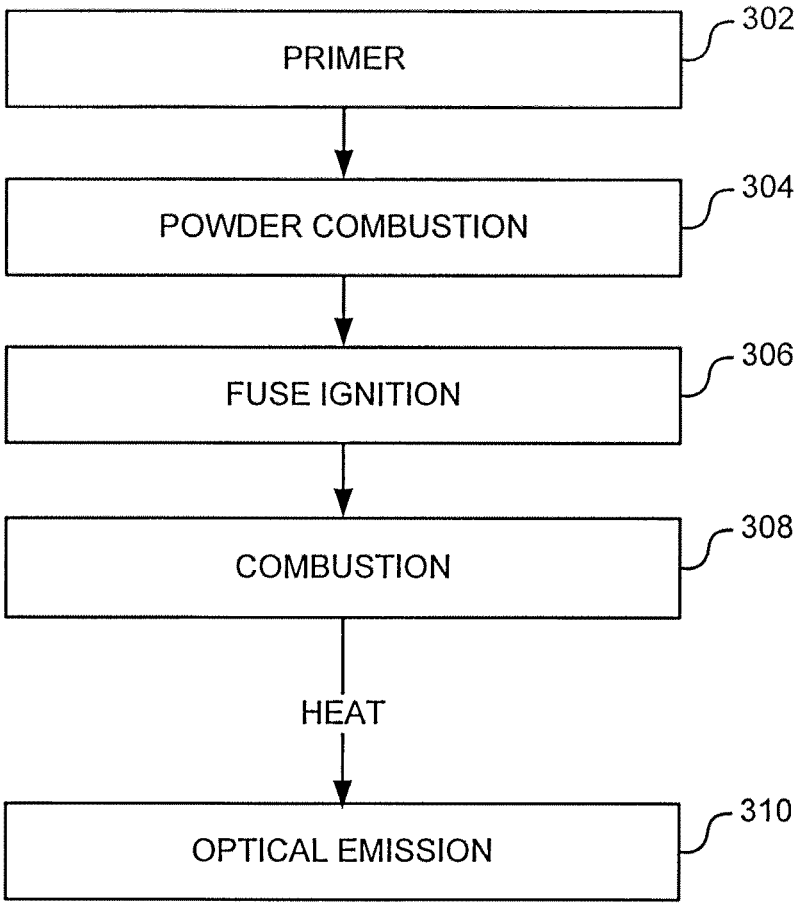
FIG. 5 is a diagram illustrating an example process for a tracer ammunition combustion sequence in accordance with various embodiments of the technology disclosed herein.

FIG. 5 is a diagram illustrating an example process for the tracer ammunition combustion sequence in accordance with various embodiments of the technology disclosed herein. The example described in FIG. 5 is an example process of embodiments using a luminescent disk 202 such as, for example, a candoluminescent disk. In this example process at operation 302 primer ignition occurs. As a result of primer ignition, powder (e.g., gunpowder in the ammunition shell) is ignited and combusts at powder combustion stage 304. In various embodiments, the fuse (e.g., igniter material 206) is disposed within the projectile such that it can be ignited by the powder combustion stage 304. This is illustrated by stage 306. At stage 308, the fuse ignites the exothermic material (e.g., exothermic material 203), resulting in combustion of the exothermic material. The combustion process generates heat, which results in optical emission by luminescent disk 202. This is illustrated at stage 310.

Figure 6:
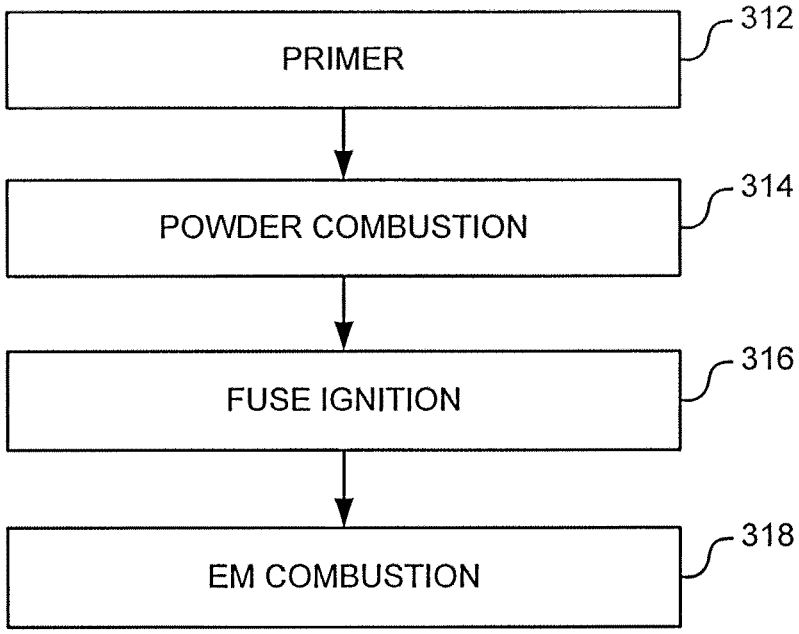
FIG. 6 is a diagram illustrating another example process for a tracer ammunition combustion sequence without a luminescent disk in accordance with various embodiments of the technology disclosed herein.

Other embodiments operate without a luminescent disk 202. FIG. 6 is a diagram illustrating an example process for a tracer ammunition combustion sequence without such a disk in accordance with various embodiments of the technology disclosed herein. The example described in FIG. 6 is an example process of embodiments implementing a tracer without using a luminescent disk 202. In this example process at operation 312 primer ignition occurs. As a result of primer ignition, powder (e.g., gunpowder) is ignited and combusts at powder combustion stage 314. In various embodiments, the fuse (e.g., igniter material 206) is disposed within the projectile such that it can be ignited by the powder combustion stage 314. This is illustrated by stage 316. At stage 318, the fuse ignites the exothermic material (e.g., exothermic material 203), resulting in combustion of the exothermic material. The combustion process generates light providing the tracer function.

In these and other embodiments, advanced exothermic materials such as thermites, intermetallics, candoluminescent ceramics, and other materials can be used to provide optical energy as product of combustion. In some embodiments, these materials are selected such that their stoichiometric formulas allow them to be easily ignited by the igniter as a result of powder combustion, and they can be so ignited with a high degree of reliability or repeatability. Preferably, these materials are also gasless or substantially gasless in order to avoid interference with the tracer emission. In various embodiments, the materials are selected such that they can be ignited by conventional igniter fuses (e.g., magnesium fuses).

In various embodiments, the exothermic materials and the luminescent disk can be chosen such that the tracer results in an approximately 2500 K blackbody emission in the visible spectrum, but with a sufficiently low infrared component, making it visible in the daytime while not saturating night-vision goggles or other night-vision devices at nighttime. Preferably, the materials are chosen to provide sufficient irradiance of the exothermic material, while considering the size, weight and power constraints for the application. Because tracer projectiles can be of limited size, these considerations can be important. The formulations can include thermites and intermetallics.

Another consideration for the materials is to choose materials that emit photons predominantly from the exposed rear-facing surface (e.g. rear-facing surface 123). This can create a backward emission. As noted above, the contour of rear-facing surface 123 and the depth of rear-facing surface 123 within chamber 116 can affect the divergence angle of the emitted photons. Preferably, in some embodiments, the divergence angle does not exceed 60°. In further embodiments, the divergence angle does not exceed 30°. In still further embodiments, the maximum divergence angle can be chosen based on the intended application or environment. For example, the divergence angle can be chosen to define the field of view of the tracer to allow visibility for personnel in the vicinity of the shooter.

Parameters that can affect the divergence angle can further include, for example, the rearward opening geometry and diameter, the recessed depth of the luminescent disk or rear-facing surface 123 of the tracer material 122, the amount of sealing provided (by the luminescent disk, for example) for the exothermic material to prevent molding constituents or reactants (e.g., iron and aluminum) from escaping during reaction, preserving the bullet mass to remain nearly constant throughout the entire trajectory, selecting materials to preserve production of broadly scattered light behind the bullet to remain visible throughout its trajectory, high thermal conductivity of the intermediate layer to prevent the exothermic material from drawing contaminants (e.g., ceramic) into the reaction from the luminescent disk, and using an insulator (e.g., magnesium oxide) surrounding the exothermic material in order to limit heat loss and to prevent melting or igniting the bullet.

As noted above, in various embodiments it is desirable to avoid emitting vapor or smoke from the projectile as this could cause unwanted scattering that may be perceptible to enemy forces. Accordingly, in various embodiments, the materials are designed such that the entire reaction takes place in a condensed state to avoid vapor or smoke. In various embodiments, the materials used, their packing and their production process are chosen to provide a substantially vaporless or smokeless operation. As noted above, having a mass-preserving operation can be an important factor as well. In further embodiments, they can be chosen so as to avoid scattering of the light emission such that the light emission cannot be detected by enemy forces or personnel outside of the defined field of view.

Any of a number of different materials can be used as tracer material 122. This includes not only iron-based thermites but also other thermite and intermetallics as well. Examples of some materials that are relatively gasless include: Al/B2O3, Al/Cr2O3, Al/$Nb_2O_5$, Al/$SiO_2$, Al/TaO5, Al/$TiO_2$, Al/U3O8, B/Cr2 O3, B/Fe2O3, B/Fe3O4, Be/B2O3, Be/Cr2O3, Be/CuO, Be/SiO2, Hf/B2O3, Hf/Cr2O3, Hf/SiO2, La/WO2, La/WO3, Li/B2O3, Li/Cr2O3, Li/Fe2O3, Li/Fe3O4, Li/SiO2, Nd/WO2, Nd/WO3, Ta/Fe2O3, Ta/WO2, Ta/WO3, Th/B2O3, Th/SiO2, Ti/B2O3, Ti/Cr2O3, Ti/Fe2O3, Ti/Fe3O4, Ti/SiO2, Zr/Cr2O3, Zr/SiO2, and any combinations of these with a 3rd or 4th constituent(s) for the thermites; and any intermetallics that include two or more constituents such as, for example, Al/(C, Ca, Ce, Co, Cr, Cu, Fe, La, Li, Mn, Ni, Pd, Pr, Pt, Pu, S, Ta, Ti, U, V, Zr), with a minimum of two metal or metal-based constituents. The improvement of their compositions for ease of ignition is described in the paragraphs below.

Aluminum titania (titanium dioxide) thermite is a desirable tracer material 122, because it produces little or no gas byproduct during its exothermic reaction. However, the challenge with this material is that it is difficult to ignite using conventional means such as a propane torch or Mg fuse. This difficulty is a result of the materials higher thermal conductivity as a result of compaction, which makes it difficult to concentrate and localize the required ignition heat at a localized spot. To overcome this challenge, an igniter layer can be added to the tracer material.

The tracer materials can be compacted into chamber 116 or, compacted in a die to form a pellet. An example composite pellet includes a titania aluminum thermite (TAT) layer at the bottom (i.e., toward the front of chamber 116) and the MTV igniter at the top (i.e. toward the rear of chamber 116). The combustion of MTV creates gas and ejecta. Once the MTV layer is burned off, the TAT layer will begin to combust. Although the MTV creates gas and ejecta, the TAT is gasless. Because TAT combustion is gasless, the TAT layer produces a bright visible glow, making it a good material candidate for tracer material 122, especially with this high level of luminance.

Aluminum silica (silicon dioxide) thermite is another candidate for a gasless thermite. The combustion sequence of a compacted aluminum silica thermite pellet or disk includes disk diameter about 0.50 inch and compacted at 500 lb. Experimental results from this formulation and geometry resulted in a combustion time of 3-4 seconds, and the visual observation showed an excellent combustion front propagating across the disk.

Several other thermites can be used for tracer applications such as, for example: 2Al+B2O3; 2Al+Cr2O3; 2Al+Fe2O3; 8Al+3Fe2O4; 10Al+3Nb2O3; 4Al+3SiO2; 10Al+3Ta2O5; 4Al+3TiO2; 16Al+3U3O8. Among these thermites, only two thermites produce gas and they are the aluminum iron oxide thermites. In these, aluminum is the fuel and the iron oxide is the oxidizer. Among these materials, aluminum tantalum pentoxide thermite (10Al+3Ta2O5) is well suited as an exothermic material for tracer ammunition due to its high density. For example, its density, ρ=6.339 g/cm3, while for 4Al+3TiO2, ρ=3.59 g/cm3, for comparison. Being a gasless thermite, its weight remains unchanged throughout the exothermic reaction. This feature allows the tracer bullet to have high impact and high penetration ballistics.

The ignitability of the igniter, i.e., measure of how easy the thermite can be ignited for a given amount of thermal flux or other excitation source, depends on factors such as, for example: powder size (smaller, better); composition (higher fuel-to-oxidizer ratio, higher combustion luminancy and ignitability); compacting pressure (higher pressure, higher thermal conductivity, higher concentrated thermal flux is needed to ignite the thermal layer).

The same parameters also be applied to gasless intermetallics such as, for example: 4Al+3C; 3Al+Cr; Al+Cu; Al+Fe; 3Al+Fe; Al+Ti, especially those with high density such as Al+Cu, for example (ρ=5.29 g/cm3). In spite of difficulties with ignition due to high thermal conductivity, ignition can be improved with proper selection of the igniter. These can also be ignited in a live fire due to the combined heat generated and the shock wave inside the rifle's chamber.

The estimated thermal conductivity results for a selected thermite (4Al+3SiO2) and intermetallic (3Al+Fe) show a growing tendency with growing compacting pressure (10.18 kpsi, 15.28 kpsi, 20.37 kpsi). For example, for fuel-rich 1.4 (4Al)+3SiO2 thermite at a temperature of t=300° C., experimental results yielded Thermal Conductivity [W·m−1·K−1] values of 1.4, 1.64, and 1.66, respectively. In average, in the temperature range of 0-600° C., results yielded a Thermal Conductivity growth of about 0.26 W·m−1·K−1. This shows, strong monotonic growth of the bulk thermal conductivity as a function of compacting pressure. Thus, in some embodiments a high compacting pressure may be used to obtain sufficiently high thermal conductivity.

Igniter materials can include, for example, Mg barium peroxide shellac (MBS), which is more effective in igniting compacted tracer materials and reduced ejecta, than Mg Teflon Viton (MTV) mixture, and iron potassium perchlorate (IPC).

In order to produce a tracer at selected wavelengths (e.g., amber, green, white), mixtures of materials can be used. For example, magnesium, barium peroxide, and shellac in the weight ratio of 17:18:2 can be used to provide a colored tracer. The tracer materials, including the exothermic materials and the contour surface can be engineered by doping with crystalline structures to enhance certain wavelengths of emission. These crystalline structures can be tailored to produce specific colors for the light emission. This can be used for a number of purposes such as, for example, to enable determination of a shooter, a platoon or group to which the shooter belongs, a specific weapon or class of weapons, and so on. In various embodiments, the emission wavelength of the crystalline structures can be selected, for example, from around 400 nm to 700 nm.

In experimental tests, the MBS igniter was tested on the 1.2 (2Al+CrO3) thermite and proved to be relatively difficult to ignite.

Ejecta-free igniter materials can be used in order to completely or substantially eliminate ejecta at the barrel exit.

Such materials can be very thin and can be ignited by an electrical spark or a high intensity heat source. Because of its thinness, the tracer amount can be increased, leading to a longer its visible range for the tracer ammunition.

Some embodiments can be implemented to minimize the igniter amount (tracer bullets have shorter traces but with bright outputs when they were near the uprange) and maximize the tracer amount for certain tracer formulations.

Figure 9:
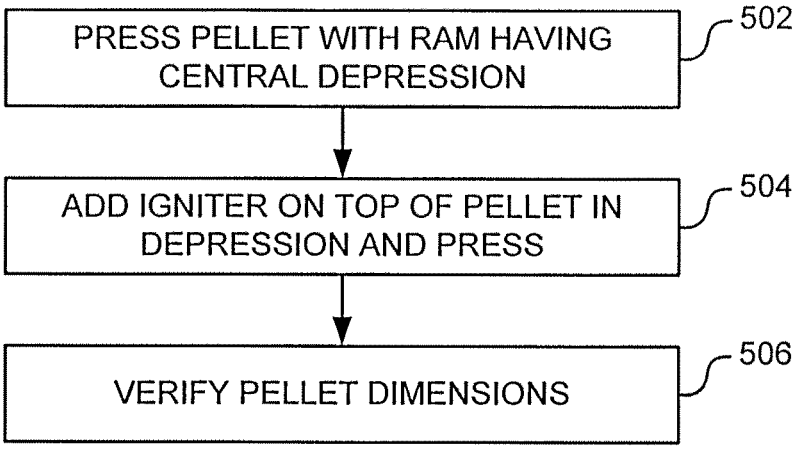
FIG. 9 is a diagram illustrating an example process for pellet fabrication in accordance with one embodiment of the technology described herein.

An example process for making a tracer pellet (e.g., a pellet of 1.2 (2Al)+Cr2O3 Thermite) is described with reference to FIG. 9.

At operation 502, the material is pressed with a ram to create a compressed pellet. In one embodiment, approximately 1.4 g of thermite is compressed into a pellet using approximately 5500 pounds per square inch of pressure with the ram. In some embodiments, the ram includes a surface contour configured to be complementary to that of a contour that is desired to be imparted upon the pellet. For example, in some embodiments the ram includes a central protuberance that makes a depression in the pellet. The igniter layer which follows, therefore extends into the thermite to give a greater area of ignition of the thermite making it easier to ignite.

At operation 504 the igniter material is added to the top of the pellet and secured in place. For example, in embodiments where the top surface contour of the pellet includes a surface depression, the igniter can be placed in the depression and the remaining depression filled with the thermite material and pressed. The amount of pressure applied can vary based on the materials but in some embodiments is approximately 4000-6500 PSI, but other pressures can be used. The igniter material can be exposed on the surface of the pellet after pressing or, in some embodiments, it can extend from the contour. Exposure of the igniter material is important to allow ignition.

At operation 506, after the pellet is formed in the press dimensions can be verified. In various embodiments, the dimensions can be verified such that the pellet will fit securely in the chamber. A pellet made using this process as an example was made to be 1 half inch wide and 0.24 inches high.

In various embodiments, press tools can be used to retrofit existing projectiles. For example, in some embodiments, bullet swaging press Corbin CSP-2 Mega-Mite with a load sensor can be retrofitted to charge projectile ammunition with tracer materials using plungers (punch) and dies. Dies and Plungers can also be made for compacting materials into the bullet's tracer cavity, compatible with 0.187" and 8.00 mm cavity diameters, or other diameters as suitable for the selected ammunition.

Examples of tools that can be used to press a pellet inside a chamber can include, for example, a press, two plungers, and a die. One plunger can be used for the tracer layer and one for the igniter layer. The bullet can be positioned inside the die while the press (e.g., Corbin CSP-2 Mega Mite Press) pushes the plunger into the tracer cavity (e.g., chamber 116). As the plunger enters the cavity, the plunger compacts the tracer material 122 and/or igniter layers depending on the plunger used. A jig can be used to extract the bullet from the die. In one embodiment, the jig includes a collet that grips onto the boat-tail end of the bullet to allow extraction of the bullet from the die.

For manufacturing the material, one technique for preparing the exothermic material uses batches of exothermic material prepared using ball milling, which provides mechanical alloying of the constituents, with milling time for each batch being on the order of 12 hours or greater. In other embodiments, ultrasound processing can be used to thoroughly mix the tracer material in suspension in a relatively short period of time (e.g., on the order of 5 min.). The suspension solvent can then be evaporated (preferably rapidly) in a warm, low-vacuum container. Various embodiments, this can be done within 10 min.

As noted above, ultrasonic processing can be used to mix the thermite constituents. For safety, various embodiments avoid using Stoichiometric ratios for mixing Al and TiO2 with isopropyl alcohol as a suspension medium (68.941% TiO2 and 31.059% by weight can be used as one example). Then, after combining Al+TiO2 with isopropyl alcohol, they may be agitated in a sonicator bath for about 10-20 min. Then, the solution may be applied to a petri dish to allow the isopropyl to evaporate. A high level of mixing uniformity is desired to provide proper in uniform burn characteristics. In some embodiments, ultrasonic mixing can be accomplished using a high-power ultrasonic processor, such as, for example, the VCX 500 by Sonics & Materials, Inc. 53 Church Hill Road, Newtown, Conn. 06470-1614 USA.

As noted above, in some embodiments it may be desirable to minimize weight loss as a result of the combustion process. Accordingly, in various embodiments, luminescent disk 202 and supportive material 207 can be designed to provide an adequate seal of the chamber 116 such that the exothermic material is sealed within chamber 116 throughout the entire trajectory path of the projectile, thereby avoiding significant trajectory deviation due to weight loss. For example, in embodiments where tracer material 122 is not sealed in chamber 116, escaping tracer material as a result of the combustion process can result in increased weight at the nose of the projectile relative to the rear of the projectile, which could affect the trajectory of the projectile.

Also, in various embodiments, the materials are selected so as to keep reactants of the exothermic material charge to have boiling points above the reaction temperature of 2500 K. This ensures that the reaction proceeds without boiling due to the exothermic reaction. Boiling is preferably avoided to prevent loss of mass of the projectile so as to not affect the trajectory of the tracer ammunition due to changes in mass during flight.

In various embodiments, the luminescent disk 202 and the tracer material 122 can be engineered to provide specific wavelengths of optical energy. Accordingly, tracer ammunition can be designed and provided such that different projectiles can be identified during their trajectory. For example, particular wavelengths can be assigned to particular individuals or used for particular classes of projectile such that the shooters or other friendly forces in the vicinity of the shooters can determine which projectiles originated from which sources based on the wavelength (e.g., observed color for visible wavelengths) of the tracer.

Figure 7:
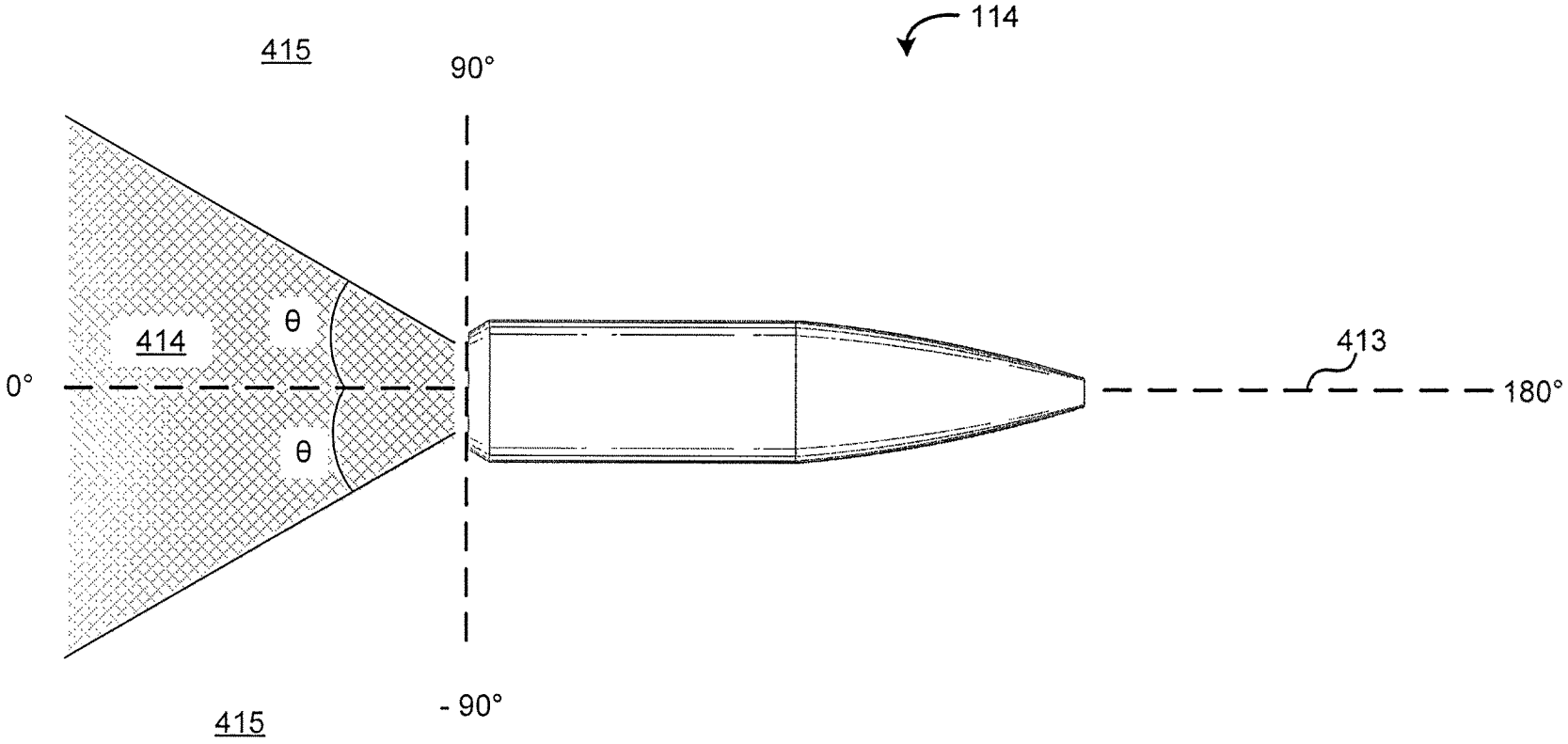
FIG. 7 is a diagram illustrating an example geometry of a visibility angle of an example tracer ammunition in accordance with one embodiment of the technology described herein.

FIG. 7 is a diagram illustrating an example geometry of a visibility angle of an example tracer ammunition in accordance with one embodiment of the technology described herein. In the illustrated example, a tracer ammunition 114 (e.g., bullet or shell) is traveling along a trajectory illustrated by dashed line 413. The tracer is visible in this example within a field of view 414 illustrated by the crosshatched area. As shown in this example, the field of view 414 is equal to 20 in the two-dimensional case, were theta is the half angle of the backward view. In some embodiments, the tracer is not visible to observers in the region 415, which falls outside of the field of view 414 of the tracer. In some embodiments, the half angle, theta, can be in the range of 10° to 30°, however other half angles are permitted and can be chosen based on intended applications and environments. Selection of the field of view can be made based on the size of the area surrounding the shooter within which it is desired that the tracer be seen, the projected trajectory of the ammunition such that the tracer can be seen as the projectile changes its orientation (roll, pitch, and yaw) throughout its trajectory.

Figure 8:
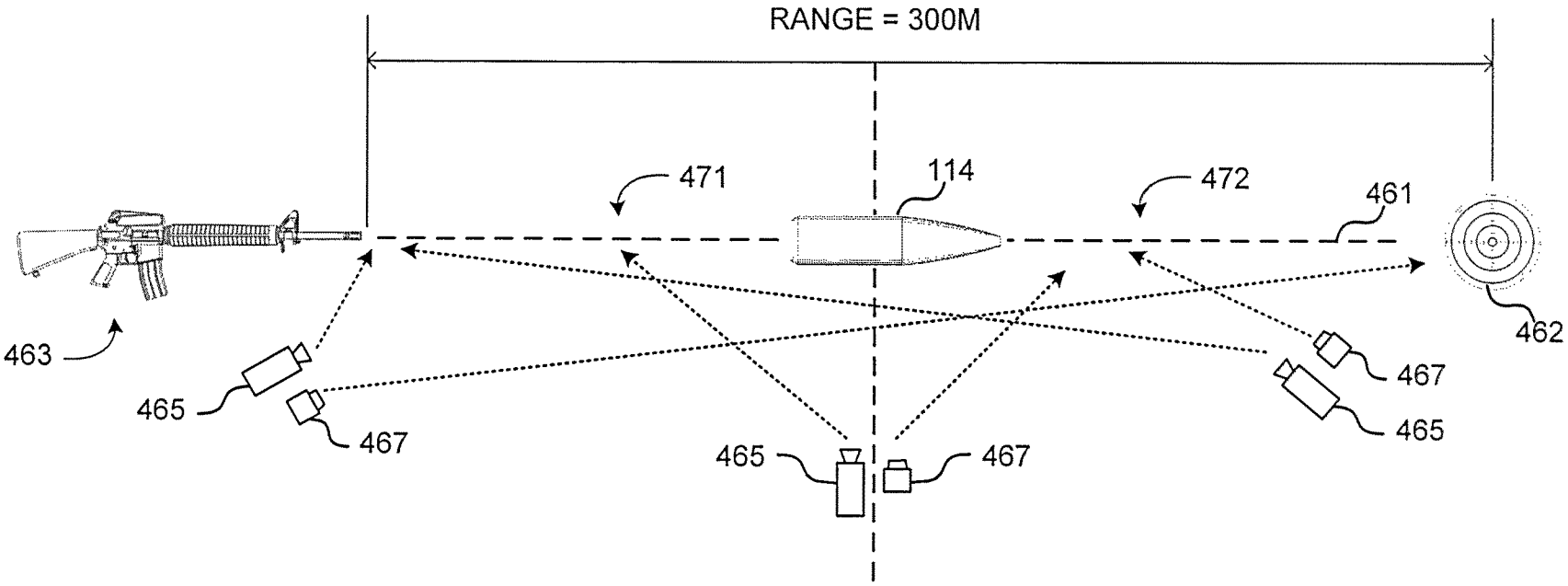
FIG. 8 is a diagram illustrating an example imaging system used for the validation or truthing of the tracer ammunition.

In various embodiments, imaging systems can be used to observe tracer ammunition for testing, validation, and other purposes. FIG. 8 is a diagram illustrating an example imaging system used for the validation or truthing of the tracer ammunition. This example illustrates an example tracer ammunition 114, in this case fired from a weapon 463 toward a target 462. In this example, weapon 463 is a rifle, however, other weapons can be used. Likewise, target 462 is a firing range target, but other targets such as, for example, enemy forces, game, or other targets can be utilized. This example shows 3 imaging systems each of which include a still camera 467 and a video camera 465.

In this example, the imaging systems were used to observe the trajectory 461 of the tracer ammunition 114 from the weapon 463 to the target 462. In the diagram, trajectory 461 is illustrated as a straight line for illustration purposes only. In reality, it is anticipated that there is some declination in the trajectory.

In practice, each of the 3 imaging systems were used to observe the experimental scenario, and were arranged to capture images from critical observation points or regions of interest (ROIs) defined as the muzzle of weapon 463, the target 462 and midrange points 471, 472.

Samples from these tests were recorded in the results tabulated with rankings "no trace," "very dim," "visible," "Bright," and "very bright,". Annotations were added such as "short trace," "short range," "short right trace," and so on. These tests were for experimental validation, training and development purposes only. Live fire testing has been successfully conducted using the described imaging system, which recorded the VOSTA projectiles traces from the weapon 463 to the target 462. Long exposure photography from imaging system at ROI 463 clearly showed the projectile's epicylic motion. However, long exposure photos from imaging systems at ROIs 471, 472 do not show any trace of the projectiles. This test was repeated for comparison with conventional, standard tracer ammunitions. Long exposure photography of a standard tracer round captured by the same imaging systems shows visible ejecta that creates a continuous streak of light in the photos obtained from all three imaging systems at ROIs 463, 462, 471, and 472.

In some embodiments, a unique remote camera trigger can be included to trigger the camera shutter when it receives a signal from a walkie-talkie, for example. In some embodiments, a single-board microcontroller (μC) from Arduino, an open-source electronics prototyping platform, can be used to generate the trigger to trigger the camera shutter upon receiving a signal from the walkie-talkie. As will become apparent to one of ordinary skill in the art after reading this disclosure, other techniques can be used for shutter triggering.

The Trigger Unit can be connected to the camera and to the receiving walkie-talkie. When the receiving (Rx) walkie-talkie receives an audio signal input from the transmitting (Tx) walkie-talkie, it sends a voltage pulse to the Arduino, which then triggers camera. Two or more receivers can be shared to a single transmitter. This allows for synchronization of multiple cameras downrange.

Testing with this configuration revealed, using five live fire tests in daytime, twilight and nighttime, that tracer ammunition according to the technology disclosed herein are imperceptible to downrange cameras and camcorders looking toward the shooter or perpendicular to the tracer trajectory.

In various embodiments, the tracer ammunition can be configured to have a sufficiently deep chamber to allow placement of the exothermic material into the chamber for compaction. A chamber that is too shallow can limit the amount of tracer material that can be poured into the tracer cavity for compaction. This can be especially true considering that low-density tracer materials require a larger volume for a given amount of combustion. For example, where a low density tracer is to be compacted into a tracer cavity, where the chamber is shallow the material will have to be split into parts for two compactions. For example, a first light compaction can be used to press part of the material into the bottom of the cavity. Sufficient compaction of the first portion of the material creates additional volume so that the second portion can be poured into the chamber for a second compaction. In some embodiments, the first compaction can be relatively light (e.g., a few hundred pounds), and the second compaction heavier. However, it is noted that compaction into layers such as this may lead to unwanted ejecta during combustion and difficulties with ignition.

As a result compaction, the tracer material is compressed in the tracer layer becomes thinner than in the under compacted state. A programmable press can be used in various embodiments to control the compaction and its effects on the tracer material. Particularly, a programmable or processor-based/computer-controlled press can be used to provide predictable amounts of pressure as compared to, for example, a hand press.

As the tracer materials combust, their luminance decreases as they travel toward downrange, however, they generate a significant amount of heat, which is wasted. In various embodiments, tracer material that can be used includes nanomaterial such as, for example, fluorescent crystalline structures. These materials can convert heat to different colors of light, and are available from Cytodiagnostics and Intelligent Material Solutions Inc., for example.

The size of the nanopowder can affect the combustion. For example, larger nanopowders (e.g., in the size range of 70 nm, 100 nm, or even submicron size) can be sufficient to increase the tracer ignition rate. Therefore, it is possible to slow down the combustion rate (or combustion speed) to allow the tracer to be more visible when it is downrange.

Figure 10:
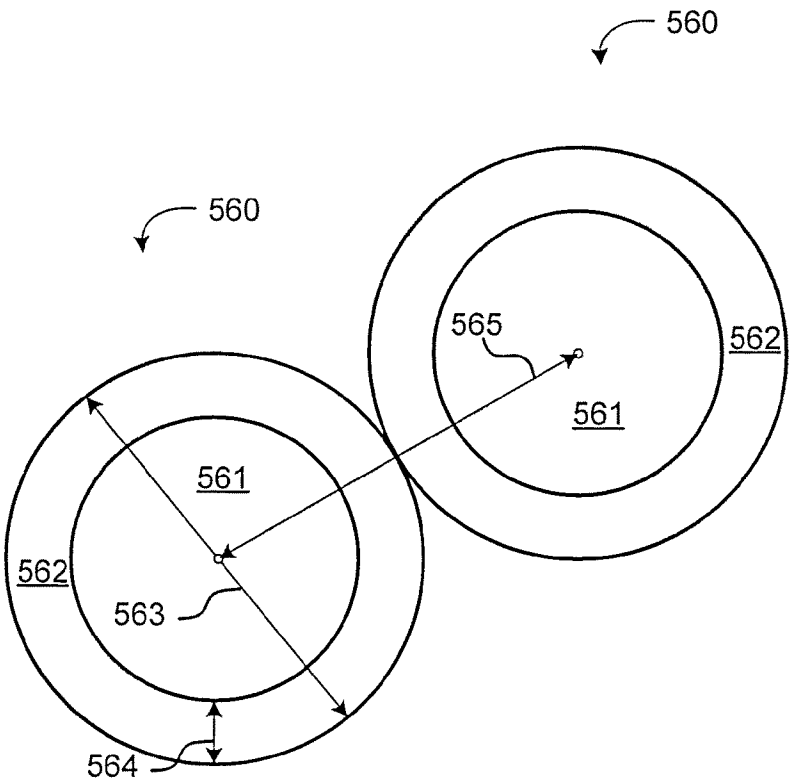
FIG. 10 is a diagram illustrating an example of a nanomaterial structure in accordance with various embodiments of the technology disclosed herein.

In various embodiments, the nanomaterial used to make the tracer material has a single continuous material region with a sub micrometer (μm) size on the order of 10 nanometers (nm) to several 100 nm. FIG. 10 is a diagram illustrating an example of a nanomaterial structure in accordance with various embodiments of the technology disclosed herein.

Referring now to FIG. 10, in this example, the tracer material subsystem includes nanoparticles 560 each having a core 561, and an outer inert layer 562. In the illustrated example, only two nanoparticles 560 are shown, however, as would be understood by one of ordinary skill in the art after reading this description numerous nanoparticles can be included. This example illustrates that the nanoparticles 560 have an average diameter 563 and an average thickness of the outer inert layer 562 is shown by the dimension 564. The center-to-center spacing of the nanoparticles 560 is shown as dimension 565.

The size (e.g., average diameter 563) can refer to the average extent of the nanoparticles in any direction for nanoparticles that are not spherical. The core 561 of the nanoparticles can be an exothermic material such as thermite. The outer inert layer 562 can comprise an inert material such as an oxide, which can be specifically coated on the core 561, for example, or can be created as a result of a natural process such as, for example, oxidation. Alternatively, outer inert layer 562 can be grown in a controlled manner such as, for example, by a process replicated in the laboratory.

When compacted into a pellet (e.g. compacted by a press) the resulting solid will have a plurality of nanoparticles 560 separated by an average distance (e.g., dimension 565) between their centers. Inclusion of the outer inert layer 562 (e.g., an oxidation layer) enables production of heat while avoiding ejecta. This is contrary to practice with conventional materials because, with traditional energetic materials, great effort is typically devoted to avoiding the formation of an outer inert layer 562. Claim oxide layer to avoid ejecta In various embodiments, the size of nanoparticles 560 is, on average, between 80 to 100 nm. This differs from the size of such particles used in fireworks, which are typically between 1 μm (1,000 nm) to 80 μm (80,000 nm). It is generally understood the field of energetic materials (such as explosives) that smaller particle sizes helps ignition. However, this is conventional wisdom does not hold true in the case of the materials used for tracer material 122. This is because materials grown in ambient conditions or in air, for example, and not in an inert environment (such as an inert gas chamber), and therefore have an outer inert layer 562. This outer inert layer 562 is an oxide in the case of thermite. The thicker the oxide layer, the more difficult it is to ignite the energetic materials. For tracer ammunition applications, the addition of this unconventional oxide layer yields unexpected results and benefits:

First, for an ideal tracer material 122 in accordance with the technology disclosed herein is not the ignition of materials that are desirable, but only the initiation of the exothermic reaction. Once the reaction is initiated, a slow, controlled reaction is desired to allow luminance for longer duration along the trajectory. Structuring nanoparticles with a core 561, and an outer inert layer 562 yields the benefit of an exothermic reaction with no ignition.

The spacing (e.g., dimension 565) between nanoparticles 560 is roughly equivalent to the particle size. That is, in various embodiments, the nanoparticles 560 are closely packed. At this separation, heat from all of the nanoparticles 560 aggregates to increase the temperature to that of a black body such that the emission of light from the tracer material is in the visible (wavelengths between 400-700 nm) to near infrared (wavelengths between 700-1200 nm) portion of the optical spectrum.

Second, with no ignition of the materials, there is no ejection of material, which would otherwise result in the mass of the material changing over time. As noted above, it is a desirable feature to maintain mass of the tracer to better match the trajectory, weight and lethality of the non-tracer ammunition to which the tracer is applied.

Third, with no ignition of the material, there is no gas emission from the chamber. Gas emission would otherwise result in light scattering material around the tracer that could make the tracer visible from all directions, not just in the direction of the shooter.

Fourth, the ability to produce nanoparticles 560 in ambient/air environment, rather than in an inert gas chamber (inert environment) offers cost benefits.

Fifth, optimal exothermic material to oxide ratio can be achieved by a hybrid approach of combining micron sized particles (1-80 μm) with nanoparticles (80-100 nm size). The benefit is the cost of the material. Nanoparticles can cost as much as $1400 per kilogram, while micron sized particles (such as thermite used in fireworks) cost about $30 per kilogram. Using micron-sized particles in the hybrid reduces overall cost of the tracer material 122.

Energetic material powders such as gunpowder, pyrotechnics and others are typically fabricated using ball milling techniques. Ball milling is a relatively slow process that can be used to produce powders in large batches. Use of ultrasonic means to break solids into smaller particles is typically used in research and, to our best knowledge, have been avoided in manufacture due to low throughput. In various embodiments, a tracer material fabricator can be implemented using a cascaded ultrasonic fabrication process in which powders of tracer material can be fabricated in large volumes.

Figure 11:
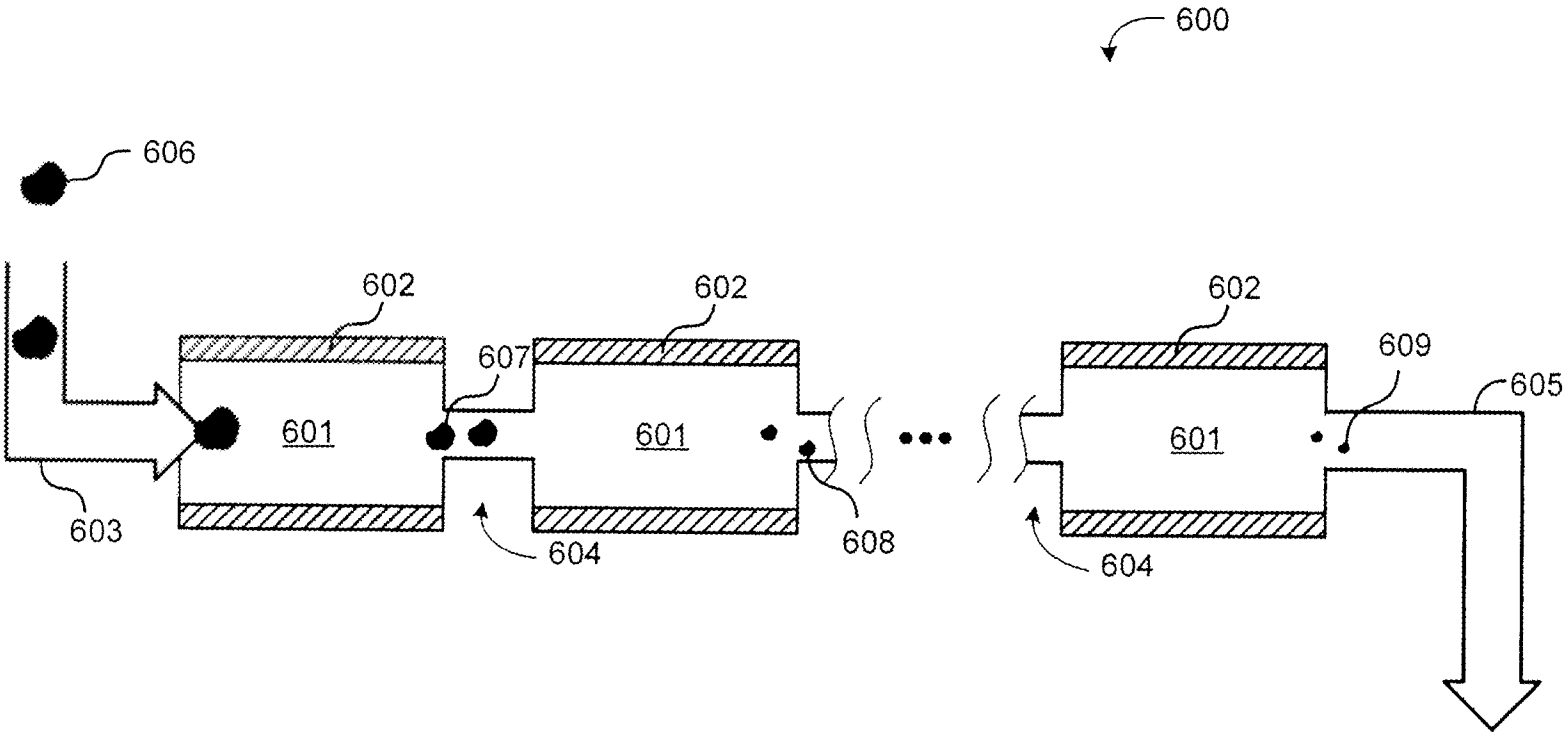
FIG. 11 is a diagram illustrating an example process for material production in accordance with various embodiments of the technology disclosed herein.

FIG. 11 is a diagram illustrating an example process for material production in accordance with various embodiments of the technology disclosed herein. In the example illustrated in FIG. 11, the material fabricator 600 includes a series of interconnected ultrasonic workstation 601. The number of ultrasonic workstation 601 that can be included with material fabricator 600 can vary, and can be selected based on the desired material throughput. For example, in various embodiments, 5 to 10 ultrasonic workstations 601 can be used; however, in other embodiments, other quantities can be used.

In the illustrated example, each ultrasonic workstation 601 includes one or more ultrasonic transducers 602, which are configured to generate ultrasonic energy in the workstation. In this example, the ultrasonic workstations 601 are connected to one another via interconnection paths 604, which can be implemented, for example, using pipes or other flow channels to allow material to flow from one ultrasonic workstation 601 to the next ultrasonic workstation 601.

Also in this example is shown in input inlet 603, which can be implemented, for example, as a pipe or other input flow path. In operation, relatively large pieces of exothermic material 606 enter the material fabricator 600 through input inlet 603. The materials are processed in series through the ultrasonic workstations 601 (from left to right in the diagram).

The last ultrasonic workstation 601 in the illustrated material fabricator 600 is connected to an outlet path 605, which can be implemented, for example, has a pipe or other flow path for material.

In operation, larger chunks of exothermic material 606 enter material fabricator 600 via input inlet 603. The chunks of exothermic material 606 enter and are processed in the first ultrasonic workstation 601, in which they are broken down into smaller particles 607 by the application of ultrasonic energy thereto. As these particles pass through subsequent ultrasonic workstations 601, they are successively broken down into smaller and smaller particles 608, 609, by the application of ultrasonic energy and eventually emerge from the final ultrasonic workstation 601 with particles of a desired size. These final particles 609 emerge from outlet path 605.

Processing sizes can vary, but, in some embodiments, exothermic materials 606 entering the system can be millimeters or larger. Likewise, final particles 609 can be of a desired size from several tens of micrometers to several nanometers. The number of stages, the processing times, and the amplitude and frequency of the ultrasonic energy are parameters it can affect the final particles size.

Figure 12:
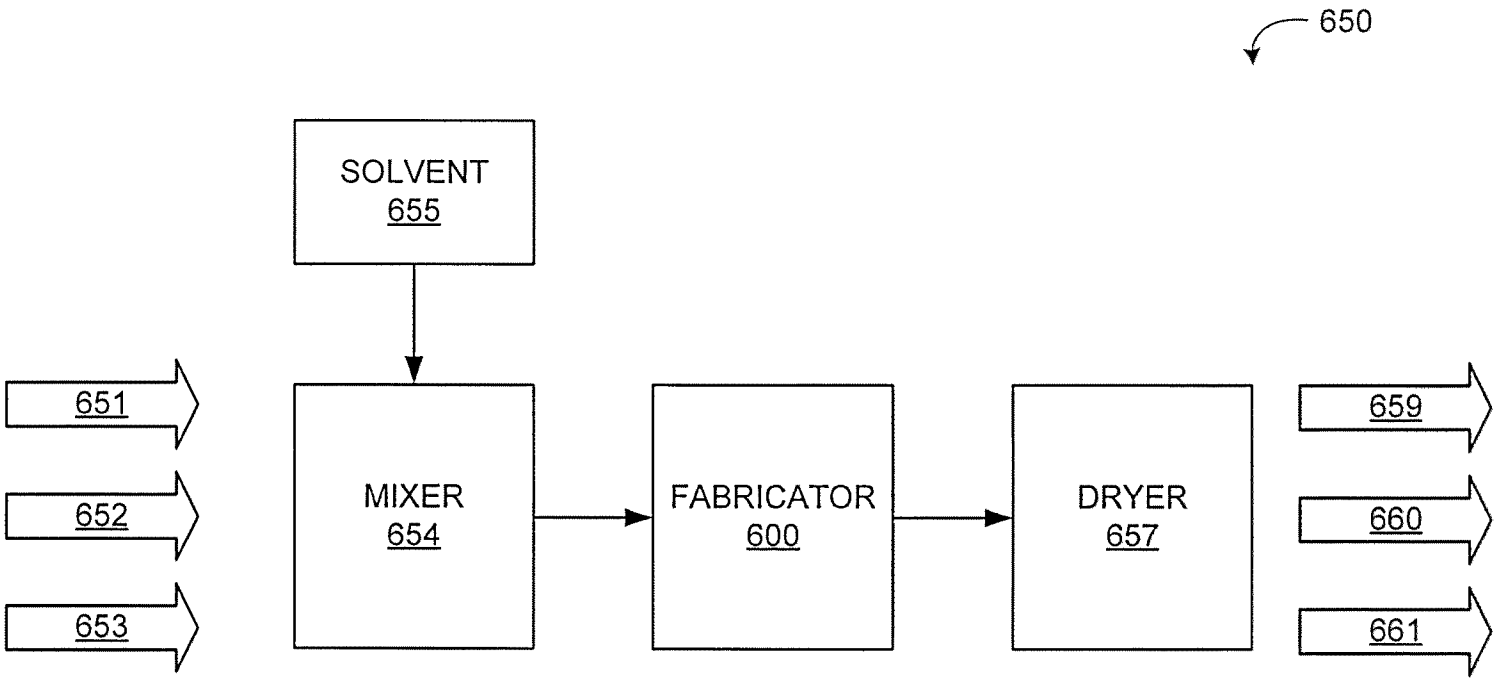
FIG. 12 is a diagram illustrating an example of an overall process for tracer material fabrication in accordance with one embodiment of the technology described herein.

FIG. 12 is a diagram illustrating an example of an overall process for tracer material fabrication in accordance with one embodiment of the technology described herein. This example includes an ultrasonic processor such as, for example, material fabricator 600 as shown in FIG. 2, although other processors can be used.

As illustrated in the example of FIG. 12, tracer materials 651, 652, 653 are provided to a mixer 654. A solvent 655 is also delivered to mixer 654. Mixer 654 mixes the material with a solvent in preparation for processing (e.g., in preparation for ultrasonic processing).

After processing to reduce the midsize (e.g., ultrasonic processing) the material are passed through a dryer 657 to remove any solvents and dry the material, resulting in powdered tracer material. As noted above, the process can be tailored to generate particle sizes from several hundred microns down to several nanometers.

As illustrated in the example of FIG. 12, the powder can be output in 3 fanned out streams 659, 660, 661. Other numbers of streams can be used depending on, for example, particle sort criteria. Particle size and particle quality are examples of sort criteria they can be used in a soaring operation at the output of dryer 657.

In yet a further embodiment, the quantity and duration of the ultrasonic processing steps can be very to scale the operation. In some embodiments, the quantities can be increased to allow the ultrasonic method to match the production volumes of traditional ball milling approaches.

Figure 13:
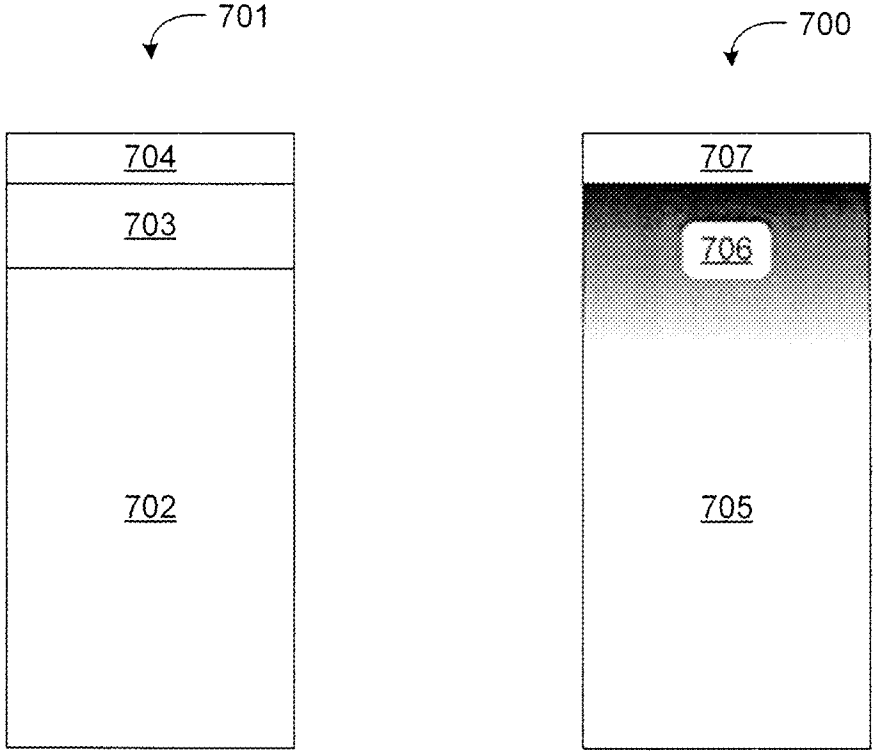
FIG. 13 is a diagram illustrating an example tracer material integrative compacting concept according to various embodiments of the technology disclosed herein.

FIG. 13 is a diagram illustrating an example tracer material integrative compacting concept according to various embodiments of the technology disclosed herein. FIG. 13 also provides a comparison of this example concept to conventional products produced as a result of compaction. As noted from FIG. 13, in this example, the conventional solution 701 uses 3 separate materials. These are an energetic material 702, a light producing material 703, and a seal 704. In contrast, in the example product 700 in accordance with embodiments disclosed herein, the 3 materials, the energetic material 705, the light producing material 706, and the seal 707, are integratively compacted into a single material block. This integrative compacting can yield a material that has limited or no outgassing, or substantially no outgassing.

As noted above, in various embodiments it is a goal of various embodiments to minimize and confine burning ejecta. Although burning ejecta can be useful for tracer action (and indeed is used with conventional tracer ammunition), ejecta with the technology disclosed herein is preferably confined to limit visibility to the shooter area. Implementing tracer material such that ejecta in the projectile cavity is small can provide the added benefit of not saturating night vision goggles (NVG). This is because, the confined nature of the tracer material saturates only a few pixels on the NVG imaging device and therefore does not compromise visibility of the NVG user.

As noted above, the shape of the press is used to confine, compact or compress the tracer material can have a defined contour to provide a desired complementary contour to the tracer material pellet. Likewise, other techniques for manufacturing or shaping the pellet can be used to provide the desired contour on the top surface (i.e., backward facing surface) of the pellet. The contour of the pellet surface can be implemented in various embodiments to help achieve features in the tracer ammunition such as, for example, optimal ignition temperature, preventing of cracking thus minimizing or preventing ejecta, and contribute to the homogenization of light to achieve Lambertian or near Lambertian light sources. The use of Lambertian light sources can help to confine the exit angle of the visible tracer.

Figure 14:
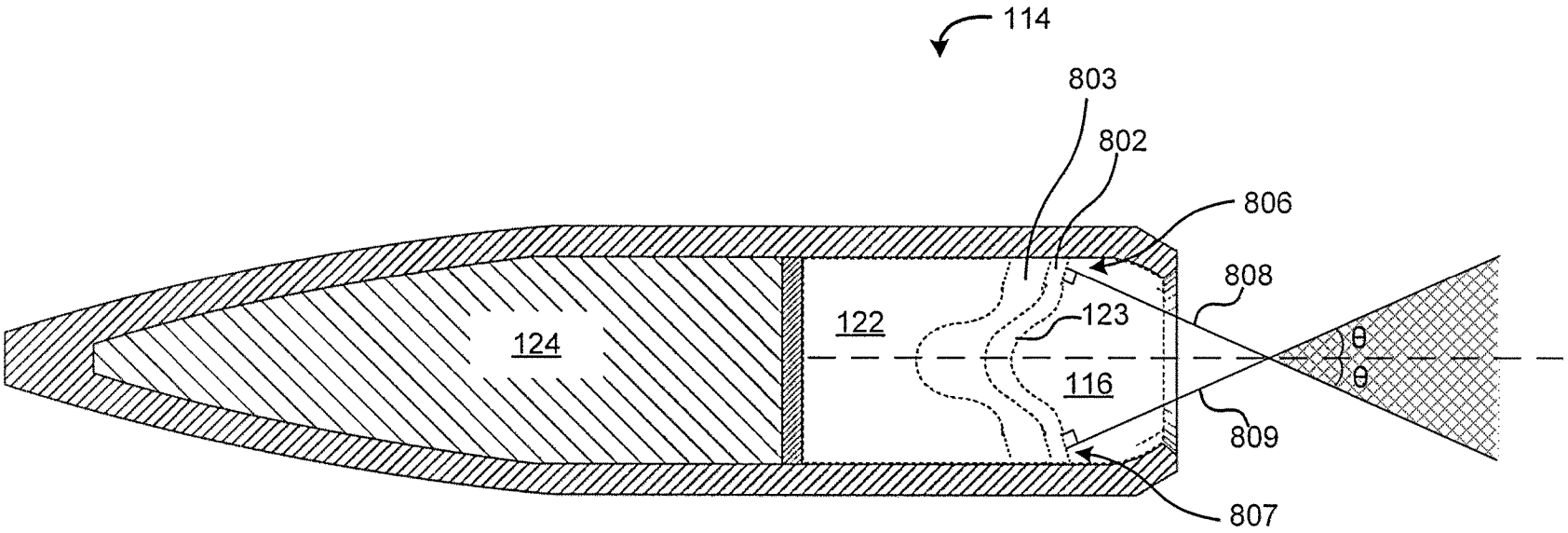
FIG. 14 is a diagram illustrating an example contour for the tracer material in accordance with one embodiment of the technology disclosed herein.

FIG. 14 is a diagram illustrating an example contour for the tracer material in accordance with one embodiment of the technology disclosed herein. The example shown in FIG. 14 illustrates details of example pellet pressed into a cavity or chamber 116 of tracer ammunition 114. As noted above, a press can be used to compact tracer material 122 into chamber 116 and generate a contour on the rear-facing surface 123 of the pellet. The contour on the rear-facing surface 123 can be shaped such that the surfaces at the outer edges of the contour direct rays of light 808 and 809 to create the desired field of view 414 toward the shooter. In various embodiments, rays of light 808, 809 are generated perpendicular to the surfaces at the outer edges of the contour.

In some embodiments, to enhance the effect of confining the visibility of the tracer ammunition to the area of the shooter, additional layers of material can be added to the pellet. For example, in the embodiment illustrated in FIG. 14 a light emitting material 802 and a light reflecting or scattering material 803 are included in the pellet of tracer material 122.

These dopant materials can improve the desired effect of backward propagation of light. For example, light emitting material 802 can include materials integrated into, layer upon, or partially diffused into the energetic materials to generate light at desired wavelengths upon heating the energetic material. Light emitting materials 802 can be chosen to generate light and a given wavelength such that the tracer ammunition can have a "signature."

The light emitted by such light emitting material 802 can, in some embodiments, emit light in all directions. Light propagating inward toward the interior of chamber 116 can therefore be lost, and not contribute to the tracer effect. To make use of this otherwise lost light, a second materials layer, light reflecting or scattering materials 803, can be included to reflect light generated by light emitting materials 802 toward the rear of chamber 116. Light reflecting or scattering materials 803 can include, for example, white scattering particles, such as silica, alumina and others.

The contour in this example minimizes the axial normal area; i.e., surface area with normal quasi-parallel to axis in order to "clip"—angular distribution, to be close to a Lambertian source at large distances, or infinity. In particular, the boundary elements 806, 807 should have normal 808 and 809, respectively. Orientation of the boundary elements is such that the emission of light is Lambertian but clipped to the angles that lie between rays 808 and 809.

In various embodiments, the tracer materials can comprise energetic material ignited by the igniter to produce heat, which in turn produces a glow leading to the tracer effect. The energetic materials can be chosen and compacted to provide a gassy or gasless effect. Providing a gasless effect is contrary to conventional thinking with tracer ammunition. Conventional tracer ammunition of which the inventors are aware, add an igniter layer with pyrotechnics, typically phosphors.

In various embodiments, the tracer pellet can include:

$$\text{Igniter}+\text{EM}+CCD \tag{1}$$

Combined together as described herein, this novel approach is unobvious to those of ordinary skill in the art, because, in conventional tracer and pyrotechnics fields, phosphors require a heat source, which, in turn requires separate ignition means.

With the igniter materials, 0.1 g to 0.2 g of igniter in the ammunition chamber 116 provides balance between ignition reliability and minimization of muzzle flash, although other quantities of igniter materials are permitted. Less than 0.1 g of igniter material can have the effect of reducing muzzle flash but may have the unwanted effect of reducing the reliability of ignition of the energetic materials. On the other hand, greater than 0.2 g of igniter materials will increase the reliability of ignition, this may come at the expense of unwanted levels of muzzle flash. Accordingly, it may be desirable to strike a balance between ignition reliability and reduction of muzzle flash. In some embodiments, muzzle flashes targeted at a level of 3 Lux, which is the typical muzzle flash achieved over conventional weapons with the use of a suppressor.

Stoichiometric formulae are typically neither necessary nor sufficient to determine ignitability a priori when the material is compacted under high pressure. For purposes of this disclosure, high pressure refers to pressures greater than 50,000 psi (pounds per square inch).

For a stoichiometric formula, consider reactants, Ci, in a reaction, where ni is the moles of reactant, Ci (ith component reactant). The set of numbers, ni, that yields complete consumption of the reactants is referred to as the stoichiometric ratio. Considering mole fractions of ni in the tracer materials—for example metal (fuel) and oxide is a good starting point. However, different from and nonobvious compared to conventional pyrotechnics, the high-pressure compaction needs to be considered in defining the stoichiometric conditions ratio we need to account for compacting to ensure ignitability.

The exact value of the stoichiometric ratio may be used as a guide to move in the proper direction to achieve ignitability. However, to maximize ignitability it is noted that the optimum mole ratio could be quite deviated, even up to 40%, from the stoichiometric ratio. This is because, in addition to providing stoichiometric ratio optimization, is also useful to include the optimal condition for compacting especially in case of nanomaterials.

For the sake of clarity, the fuel ratio is generally given by $$\left(\frac{n_F}{n_F + n_O}\right),$$

and the oxide ratio is $$\left(\frac{n_O}{n_F + n_O}\right),$$

where nF and nO are the mole fractions of the fuel and oxide, respectively. The sum of the fuel and oxide ratios must add to 1; which provides that $$\left(\frac{n_F}{n_F + n_O}\right) + \left(\frac{n_O}{n_F + n_O}\right) = 1.$$

Table 1 illustrates an example of how compacting the nanoparticle powders or nanopowder at high pressure affects ignitability. Stoichiometric ratios will generally yield ignitability for uncompacted nanopowders and powders compacted at low pressures, for example at 1,000 psi, but generally not at high pressures, greater than 50,000 psi.

TABLE 1

Departure from stoichiometric ratio for nanoparticles compacted to greater than 50,000 psi pressure

| | Ignitability (Y/N) | | |
|---|---|---|---|
| | Stoichiometric ratio | 20% Fuel Rich Ratio | 40% Fuel Rich Ratio |
| Nano Powder | Y | Y | Y |
| Nano Powder at 1,000 psi | Y | Y | Y |
| Nano Powder at 50,000 | N | Y | Y |

Stoichiometric ratio, for example, can mean the following composition for an energetic material with Aluminum (Al) and Silicon Dioxide (SiO2): $4.Al+3.SiO_2$. A 20% Fuel-rich ratio, for example, can mean the following composition for an EM with Aluminum (Al) and Silicon Dioxide (SiO2): $[(1.2\times4).Al]+3.SiO_2=4.8.Al+3\ SiO_2$. A 40% fuel-rich ratio, for example, can mean the following composition for an energetic material with Aluminum (Al) and Silicon Dioxide (SiO2): $[(1.4\times4).Al]+3.SiO_2=5.6.Al+3\ SiO_2$.

Accordingly, the optimum fuel-rich ratio range tends to be between 15% to 25%, however, ratios outside this range can be used. It is noted, the too small of a ratio may lead to a risk of no ignition, while too high of a fuel ratio is not cost-effective.

In some embodiments, pressure on the order of 50,000 psi is used to compact nano powder. High pressures are useful to allow compaction powders to pressures higher than typical chamber pressures during firing, which helps to minimize or eliminate ejecta. Typical chamber pressures, for example, in .50 BMG ammunition is about 50,000 psi.

Figure 15:
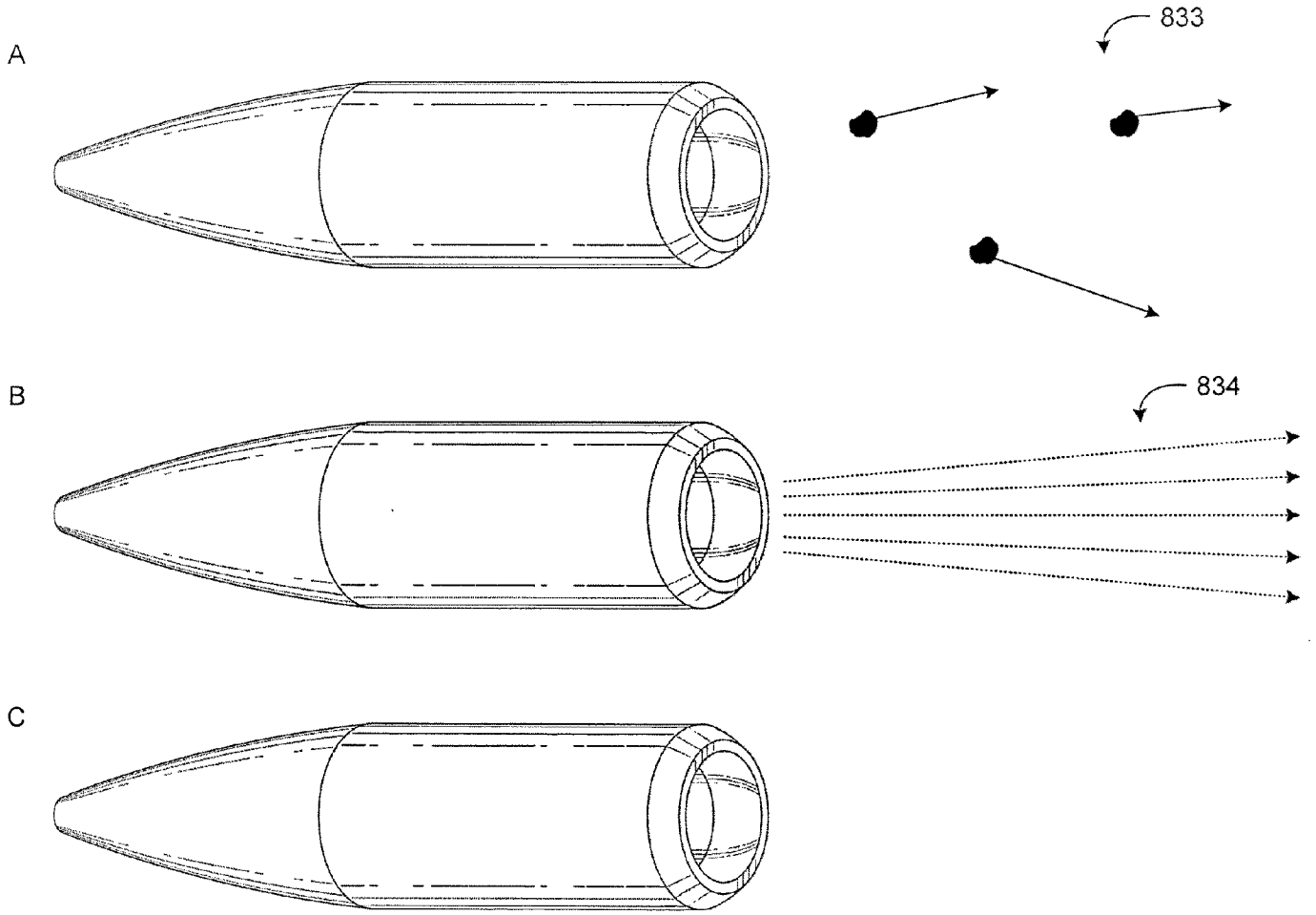
FIG. 15 is a diagram illustrating an example of the effects of compression in accordance with various embodiments.

FIG. 15 is a diagram illustrating an example of the effects of compression in accordance with various embodiments. Case A illustrates a case in which compaction is performed at less than 50,000 psi, or otherwise less pressure than needed to avoid ejecta. In this case, burning materials 833 are ejected from the ammunition in flight and can result in visibility to enemy forces. Case B illustrates the case of conventional tracer ammunition, in which compaction is greater than 50,000 psi. In this case, compaction is used to provide controlled burning of the tracer material resulting in a flame plume and/or controlled ejecta. This makes the conventional tracer visible to others beyond the shooter, including enemy forces. Case C shows the case of compaction of a tracer pellet in accordance with embodiments described herein. In this case no perceptible flames or ejected leave the ammunition. Accordingly, pressures used for visible-only-to-shooter and like tracer ammunition achieve different results from pressures used for conventional tracer ammunition.

Figure 16:
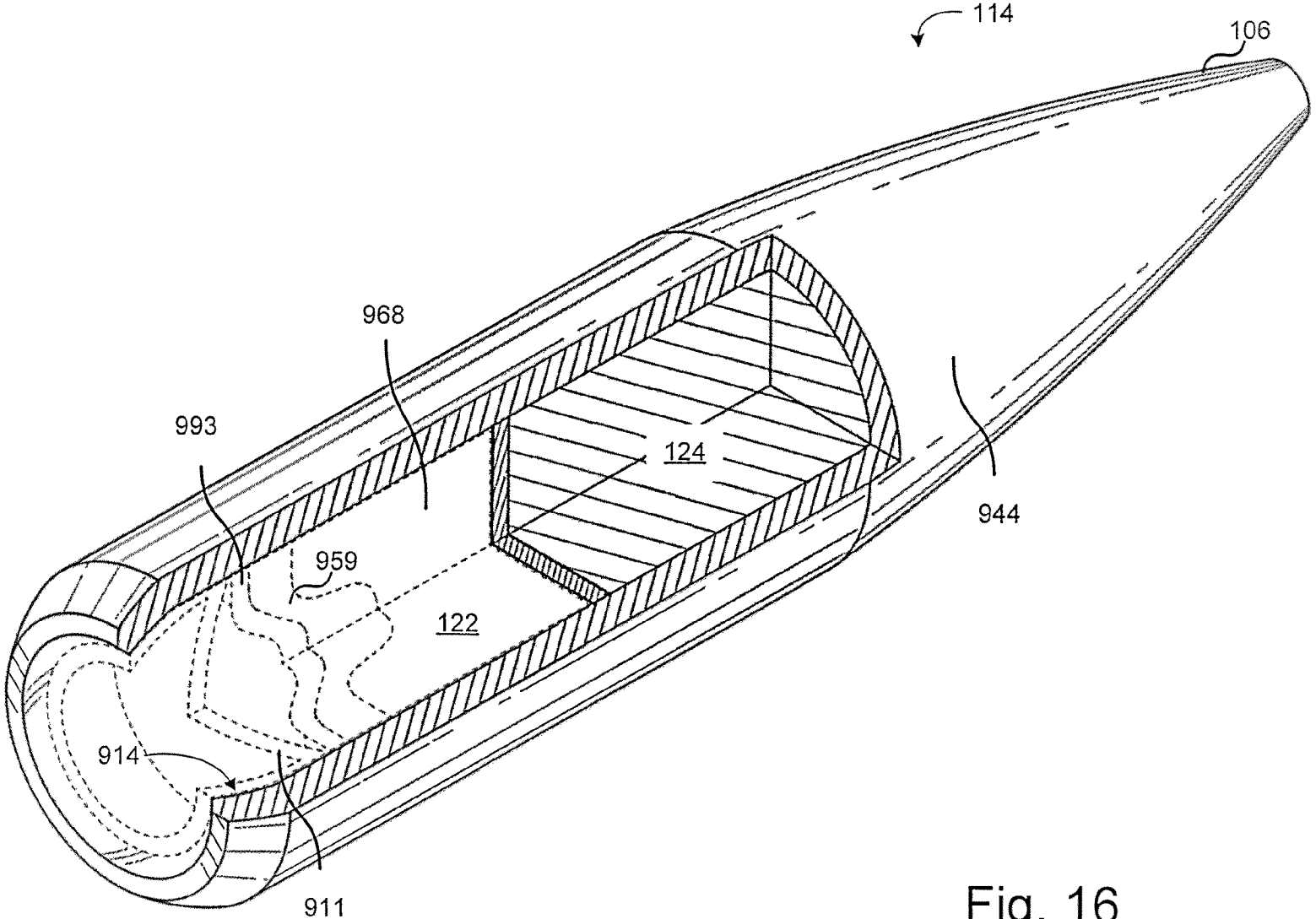
FIG. 16 is a diagram illustrating an isometric view of an integrative near-Lambertian vignetting tracer in accordance with one embodiment of the technology disclosed herein.

FIG. 16 is a diagram illustrating an isometric view of an integrative near-Lambertian vignetting tracer in accordance with one embodiment of the technology disclosed herein. As shown in this example and as described above with respect to alternative embodiments, the chamber 116 (reference not included in FIG. 16 for clarity) is a recessed cavity or space in the rear section of the ammunition to be at least partially filled with the light source, which comprises tracer materials such as, for example, tracer materials 122. The contour or shape of the surface of the rear portion of the pellet of tracer materials 122 can be configured in such a way as to provide a desired light source effects. In some embodiments, for example, this can be configured to provide a Lambertian or near Lambertian light source that is comprised of the tracer materials.

Projectile jacket 944 is part of the uncharged tracer ammunition 114. Projectile jacket 944 can be made, for example, from metals such as steel, copper, titanium, and others. In various embodiments, projectile jacket 944 can be made of the same materials as the non-tracer ammunition. Packing material 124, which can also be referred to as filler material or point filler, includes materials to fill the inner portion of the projectile. Packing material 124 can be chosen based on intended purpose of the tracer ammunition 114. For example, packing material 124 can include one or more materials such as lead, steel, armor piercing materials, incendiary materials, explosive charges, and others. As described above with reference to FIG. 4, the inner portion of projectile jacket 944 can line with an insulating material (e.g. insulating material 208 of FIG. 4), to reduce the flow of heat into the projectile jacket 944 or packing material 124.

In the illustrated example, tracer material includes 3 components. In this example these include a layer of exothermic material 968, a secondary luminescent material 959, and an igniter layer 509. Fewer or greater layers of material can be included depending on the materials chosen the application. For example, in some embodiments, a sub igniter layer (not illustrated in FIG. 16) can also be included to ignite the igniter.

The igniter (with or without one or more sub igniter layers) are used to ignite the exothermic material 968. Once ignited, exothermic material 968 produces heat. In this example, the heat produced by exothermic material 968 causes secondary luminescent material 959 to emit light. Secondary luminescent material 959 can be chosen to emit light with a predetermined emissivity.

This example also includes a closure cup 911 that can be included to keep the tracer materials 122 in the chamber 116 from degrading or falling out of chamber 116, or simply to provide some level of environmental seal for tracer materials 122 in the cavity. Also illustrated in this example is an inward sloping or vignetting of the cavity aperture. This can also be referred to as boat tailing of the trailing end of jacket 944. The vignetting can be shaped so as to control the desired field of view. As shown in the example of FIG. 16, this can be implemented as a cylindrical cavity with a reducing diameter toward the trailing end of the tracer ammunition 114. This is illustrated at reference numeral 914.

Figure 17:
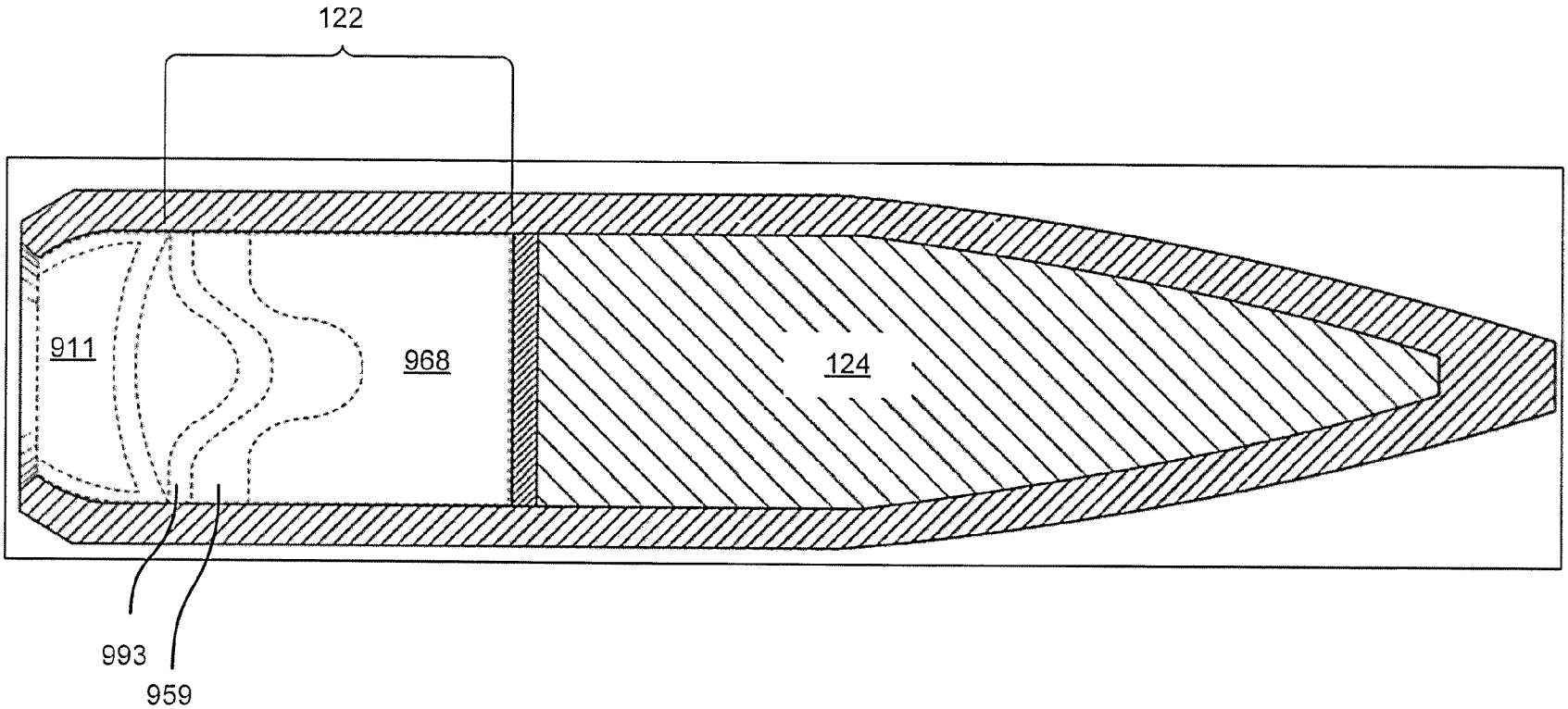
FIG. 17 is a diagram illustrating a cutaway cross sectional view of the tracer ammunition illustrated in FIG. 16 in accordance with various embodiments of the technology disclosed herein.

FIG. 17 is a diagram illustrating a cutaway cross sectional view of the tracer ammunition illustrated in FIG. 16 in accordance with various embodiments of the technology disclosed herein. This cross sectional view includes packing material 124 tracer materials 122, and a closure cup 911. Like the example of FIG. 16, this example includes 3 layers of tracer materials 122, including exothermic material 968, luminescent material 959, and igniter material 993. As seen in this example, the concourse of the rear-facing surfaces of these materials are convex with a hollowed out portion in the center. In various embodiments, the contour profile can be approximately Gaussian (rotated about 360°). As noted above additional layers can be included, including a fourth layer to form a sub-igniter layer. The cross sectional view also illustrates the boat tail or vignetting of the cavity at 914. Although not called out in FIG. 16, as with the example of FIG. 3, FIG. 17 uses reference numeral 122 to identify an insulating layer that can be included to provide insulation between tracer materials 122 and the forward portion of the tracer ammunition 114.

FIG. 16 is a diagram illustrating an isometric view of an integrative near-Lambertian vignetting tracer in accordance with one embodiment of the technology disclosed herein. 17 is a two-dimensional drawing illustrating a cross-sectional view. Although it may not be readily apparent from FIG. 16 or 17, in various embodiments, the cavity surface (e.g., the surface of chamber 116) as defined by the inner surfaces of the jacket and the rearmost contoured surface of the tracer pellet can be symmetrical or substantially symmetrical about 360° (e.g., about the central axis of the projectile. In other words, the cavity so defined can be configured to have axial symmetry. This can allow definition of the desired viewing angle about 360°.

In various embodiments, the tracer pellet can be designed such that the rear facing surface remains constant or substantially constant throughout the trajectory. As seen in the example of FIGS. 16 and 17, the rear facing surfaces of each layer (e.g., 968, 959, and 993) have the same or similar contour. Accordingly, even if the igniter material 993 were to be lost during shooting the contour of rear facing surface of the tracer pellet can remain the same or substantially the same. Likewise, in embodiments where the material is configured as a lossless mass, the shape of the cavity is not substantially or materially altered after the projectile leaves barrel. It is noted however that the shape may change to some extent while the igniter is still burning, in this burning may continue slightly apt the projectile leaves barrel. However, in various embodiments, the amount of igniter material, its burn temperature, and layer thickness, can be designed such that the igniter only burns while the projectile is still in the barrel, and this burn time is sufficient to ignite the exothermic material.

As described in this document, one feature that can be achieved with various embodiments disclosed herein is the rearward projection of the light emission from the projectile relative to the projectile's flight path. As also noted herein, this can provide a visible tracer that is visible only to the shooter were only to those in the immediate vicinity of the shooter. The vicinity within which the projectile can be seen can be defined by the various parameters as discussed herein, including, for example, the shape of the contour of rear facing surface of the tracer pellet, the contour of the chamber or tracer cavity (e.g., vignetting, if any), the burn of the materials, and so on. In some embodiments, a manifold emission front surface can be used to define the rearward facing side of the vignetting cavity such that the backward light emission exhibits a near top hat profile.

Figure 18:
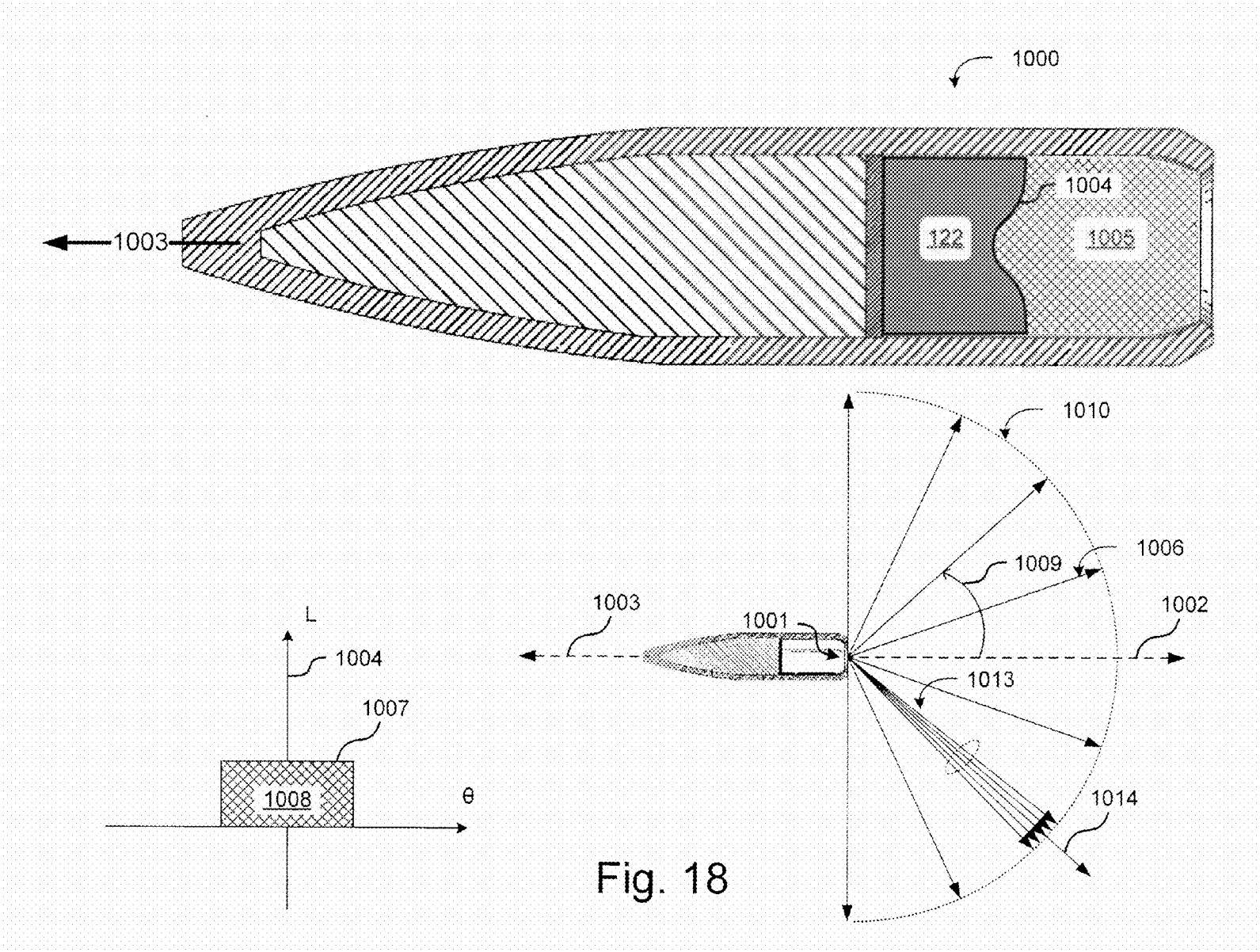
FIG. 18 is a diagram illustrating one example of rearward propagation of the light emission in accordance with various embodiments of the technology disclosed herein.

FIG. 18 is a diagram illustrating one example of rearward propagation of the light emission in accordance with various embodiments of the technology disclosed herein. Referring now to FIG. 18, in this example, a projectile 1000 travels in the direction of flight 1003. The rearward direction relative to this direction of flight 1003 is direction 1002. Surface 1004 is the rear facing contour surface of the tracer pellet. As shown in this example, surface 1004 is a concave contour surface with a depression at the center. As noted immediately above, this can comprise a manifold emission front surface. The remainder of the cavity 1005 is shown by the crosshatched area.

In contrast to conventional tracers, the result of these shapes is such that the rearward light emission 1006 exhibits a near top hat profile 1007 this top hat profile 1007 can be defined such that the total radiance L 1008 remains nearly constant as a function of the angle theta over the entire rearward hemisphere 1010. This rearward hemisphere 1010 this rearward hemisphere 1010 can be centered on the axial center of the rear facing aperture 1001 of the vignetting cavity 1005.

Total radiance 1008 in this example refers to the total energy in joules emitted from the tracer ammunition along any direction 1014 per unit solid angle 1013. Radiance may be obtained by radiometric ray tracing, IEEE, regular ray tracing with range counting done in the phase space (x, y, kx, ky) in accordance with the fundamental requirement of radiance invariance for each ray in the ray tracing. It is noted that the near top hat profile of the rearward light emission is measured at a large distance from the projectile (e.g., several hundred meters), which is the equivalent of infinity in optics.

Figure 19:
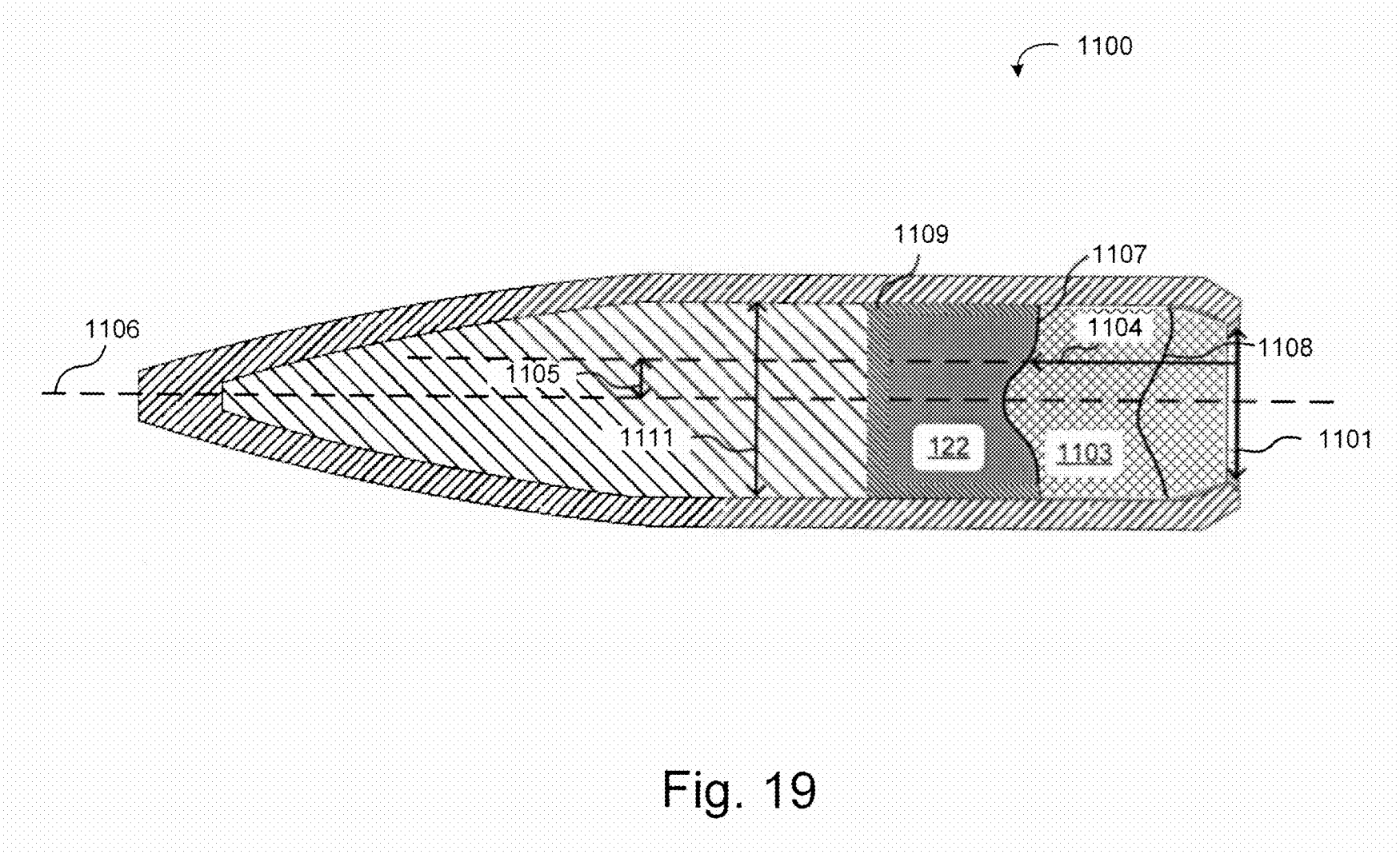
FIG. 19 is a diagram illustrating various parameters that can be specified to optimize the vignetting cavity for rearward emission of light in accordance with one embodiment of the technology described herein.

A number of parameters can be specified to optimize the vignetting cavity 1005 for rearward emission of light. These include the diameter of the emitting aperture, the depth of the cavity, the surface contour of the tracer pellet defining the front surface of the cavity, the presence of the sealing barrier, and an insulating layer. FIG. 19 is a diagram illustrating various of these parameters. Referring now to FIG. 19, the diameter 1101 of the emitting aperture can be, for example, from 50% to 90% of the maximum diameter 1111 of the projectile. Other diameters can be chosen depending on the desired characteristics of the emitted light. For example, emitting aperture 1102 can be from 30% to 50% of the maximum diameter 1111 of the projectile, or from 20% to 40% of the maximum diameter 1111 of the projectile.

The recessed depth 1104 of the vignetting cavity 1103 is also shown in FIG. 18. This recessed depth 1104 in this example and in other embodiments described herein exhibits and axial variation. That is the recessed depth 1104 varies with distance 1105 from the central axis 1106 of the projectile. This results in a manifold illumination from surface 1107 as described above with reference to FIG. 17.

Unlike conventional tracers, embodiments disclosed herein can include a sealing barrier 1108 to ensure minimal change in mass of the tracer material during flight. The sealing barrier 1108 can comprise a separate physical layer for the tracer pellet, or it can be a feature built into the tracer pellet won the manifold emissive surface 1107. Sealing barrier 1108 can be used to prevent material, whether solid, liquid or gas, from being ejected during flight. This feature, for example, can be achieved by compacting the tracer materials 122 inside a chamber 116 have sufficiently high pressures to prevent such material from breaking up or rejecting from the rear of the ammunition during flight.

Some embodiments can be configured to preserve sufficiently broad divergent light behind the bullet trajectory such that is visible not only to the shooter, but also to friendly forces in the vicinity of the shooter as discussed above. FIG. 19 also shows an insulating layer 1109 which can be provided for example around the tracer material 122. The insulating material 1109 can include, for example, an insulating material such as magnesium oxide.

In various embodiments, it is desirable to optimize the igniter layer. For example, it may be desirable to configure the igniter such that it provides reliable ignition and also burns off or is completely depleted, or substantially completely depleted, before leaving the barrel of a weapon from which it is fired. Where loss of mass may be attributable to the igniter, it is desirable that this loss occur before the projectile leaves the barrel as the trajectory of the projectile is set by the direction of the axis of the barrel.

Figure 20:
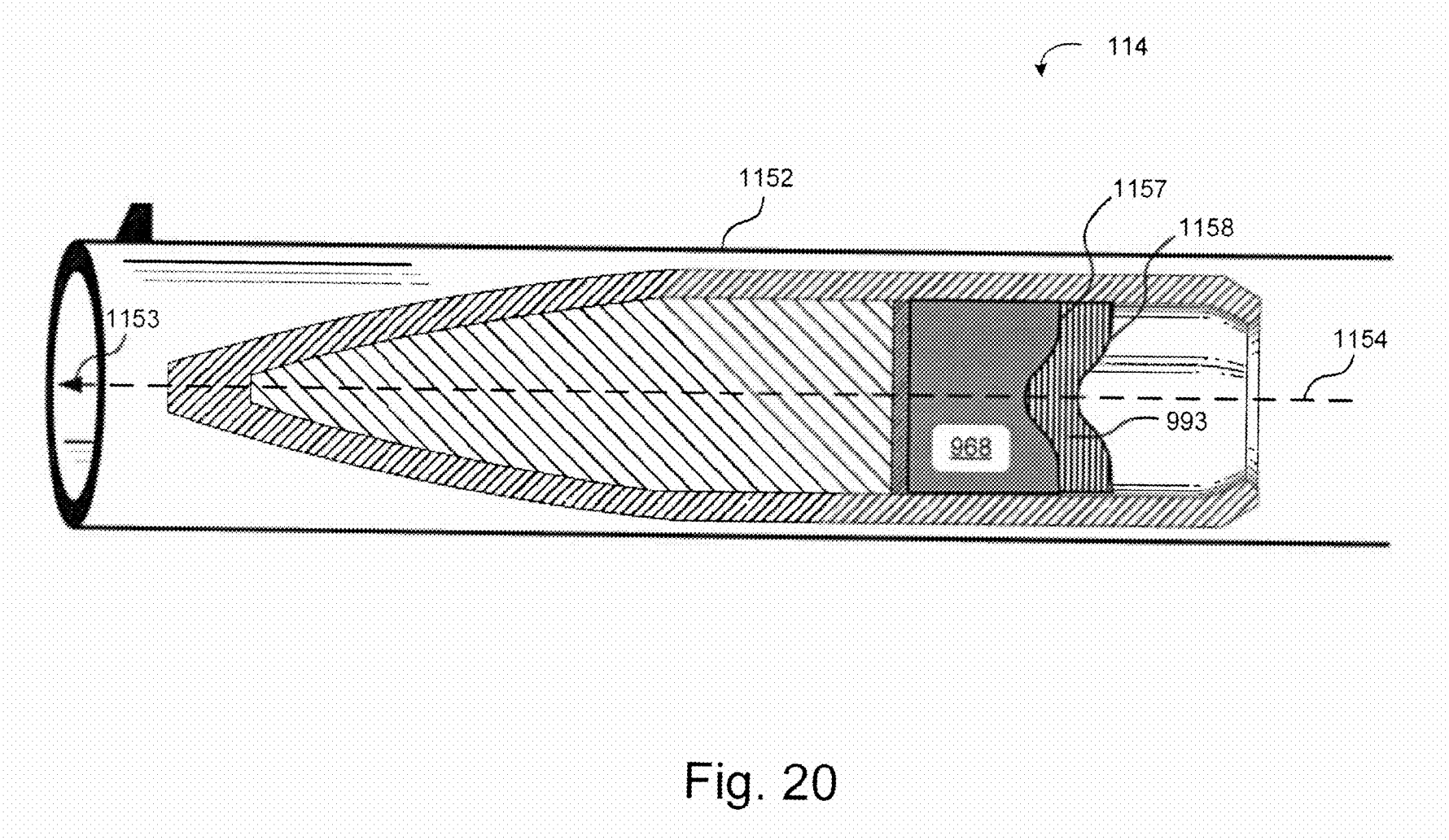
FIG. 20 is a diagram illustrating an example of igniter layer optimization in accordance with one embodiment of the technology disclosed herein.

FIG. 20 is a diagram illustrating an example of igniter layer optimization in accordance with one embodiment of the technology disclosed herein. In this example, in igniter material is shown at 1151 within a tracer ammunition 114 in the weapon barrel 1152. With typical ammunition, including typical intended uses of tracer ammunition 114 as described herein, the direction of projectile flight 1153 is established by the direction of the axis 1154 of the gun barrel 1152. It is desirable that no loss or substantially no loss of mass of the tracer ammunition 114 occurs after the projectile emerges from barrel 1152.

The igniter material 993 is contained between the outer contour surface 1157 of the exothermic material 968, and the outer surface 1158 of the igniter material 993. Accordingly, complete burn off of the igniter material 993 inside the barrel 1152 means that surface 1158 meets or merges with surface 1157 before or around the time, or at the same time or substantially the same time, that the tracer ammunition 114 leaves the gun barrel 1152 in the direction of flight 1153. This constraint can also ensure minimum muzzle flash in addition to minimal deviation from target trajectory as compared to conventional tracer ammunition.

The total mass of the igniter material 993, for example 0.1 g-0.3 g, although 30%-50% of total tracer material weight, has little or no material effect or substantially no material effect on the trajectory and performance of the tracer ammunition if it burns off inside the barrel. It is noted that sufficient igniter material (e.g., 0.1 g-0.3 g) can be used to ensure optimal temperature is reached to create thermal flux (Joule/second/square centimeter) from igniter material 993 to the exothermic material 968 to result in initiation of the exothermic reaction in exothermic material 968. This optimization can be analogized to controlled nuclear fission, as opposed to uncontrolled nuclear fission, in the sense that too much igniter material can result in mass change during flight beyond the exit of the projectile from the gun barrel, while too little igniter material may lead to a risk of non-initiation of the exothermic reaction in the exothermic material 968.

In various embodiments, oxidation of the energetic material (also referred to as the exothermic material) can be used to ensure initiation of the exothermic reaction without ejection of material.

Figure 21:
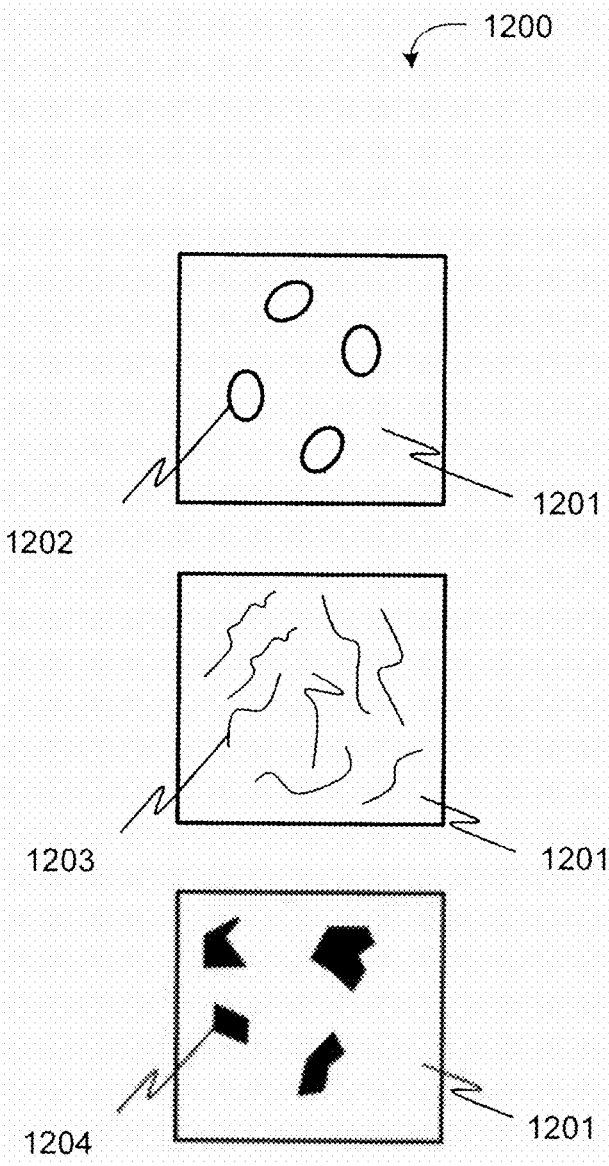
FIG. 21 is a diagram illustrating an example of oxidation achieved through the use of manifold in accordance with one embodiment of the technology disclosed herein.

FIG. 21 is a diagram illustrating an example of oxidation achieved through the use of manifold in accordance with one embodiment of the technology disclosed herein. In the example illustrated in FIG. 21, the layer 1200 comprise continuous membranes of materials 1201 with thicknesses ranging from several microns to several nanometers of materials. These membranes 1201 can be configured to hold a predetermined density of oxide material 1202. The oxide material 1202 can, in various embodiments, be shaped in different forms including, for example, in the form of nano fibers 1203 or in the form of arbitrarily shaped pieces 1204.

Figure 22:
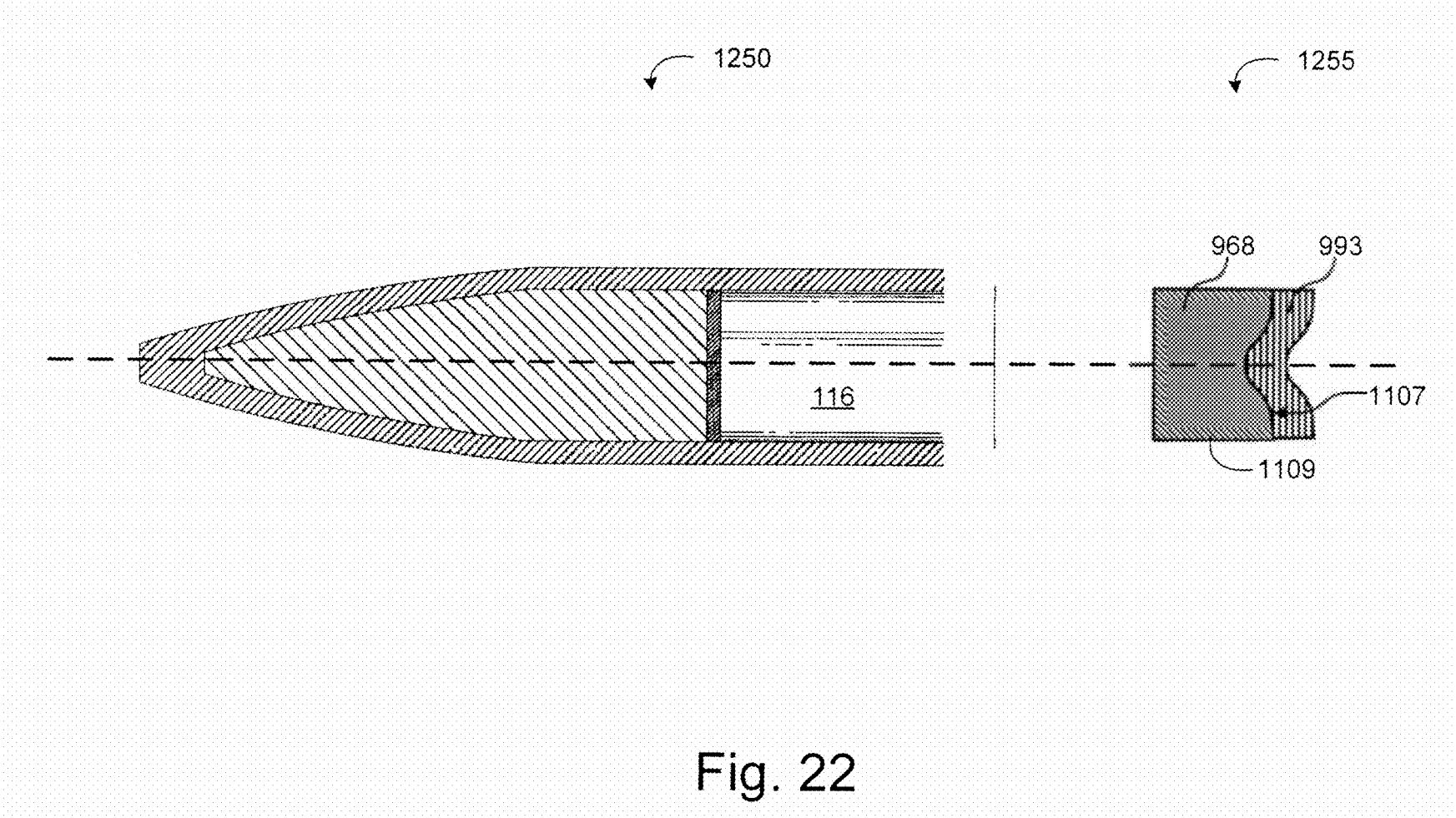
FIG. 22 is a diagram illustrating an example of pellet prefabrication in accordance with various embodiments of the technology disclosed herein.

As noted above, in various embodiments, the tracer pellet can be packed and created in chamber 116 of tracer ammunition 114. In other embodiments, as also noted above, the pellet can be formed outside of the ammunition and inserted into the ammunition before firing. FIG. 22 is a diagram illustrating an example of pellet prefabrication in accordance with various embodiments of the technology disclosed herein. As seen in FIG. 22, the process begins with an empty tracer projectile 1250 with an open chamber 116. A prefabricated pellet 1255 of tracer material (e.g. tracer material 122 including, for example, exothermic material 968 and igniter material 993) is preformed. For example, pellet 1255 can be preformed by compacting powders or other constituent components into a die, mold, or other form to create a pellet of the desired shape, size, and density. The pellet can also be preformed with a layer of insulating material 1109 (e.g. insulating material 208) and the manifold illumination front surface 1107. The prefabricated pellet 1255 can then be inserted into the empty tracer projectile 1250 resulting in tracer ammunition 114.

Figure 23:
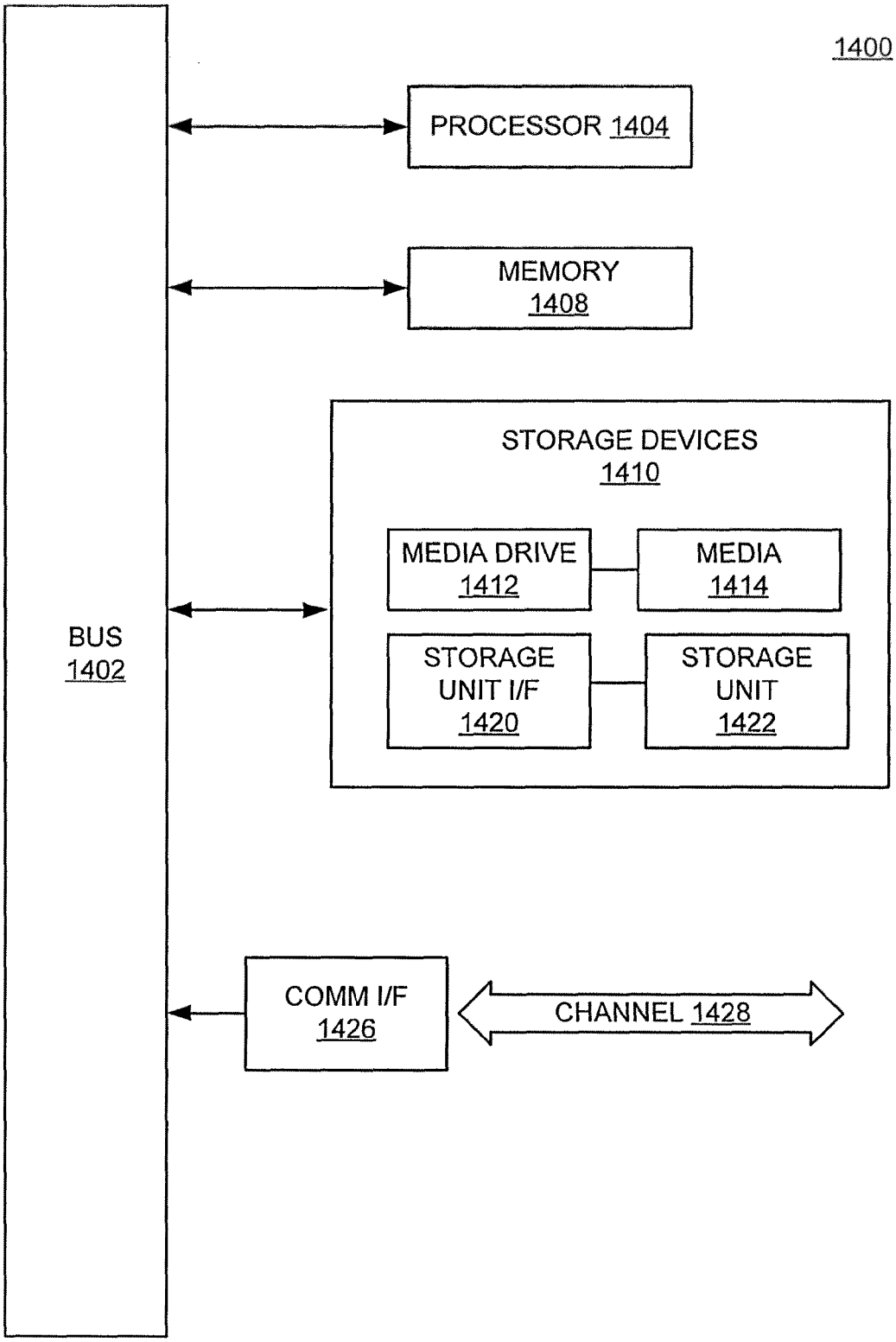
FIG. 23 illustrates an example computing module that may be used in implementing various features of embodiments of the disclosed technology.

As used herein, the term module might describe a given unit of functionality that can be performed in accordance with one or more embodiments of the technology disclosed herein. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the technology are implemented in whole or in part using software, in one embodiment, these software elements can be implemented to operate with a computing or processing module capable of carrying out the functionality described with respect thereto. Examples of this include computer control mechanisms for controlling the operation of creating tracer pellets (e.g., for controlling pressure of the ram and other manufacturing operations) and for controlling the manufacturing process for tracer materials. One such example computing module is shown in FIG. 23. Various embodiments are described in terms of this example-computing module 1400. After reading this description, it will become apparent to a person skilled in the relevant art how to implement the technology using other computing modules or architectures.

Referring now to FIG. 23, computing module 1400 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 1400 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 1400 might include, for example, one or more processors, controllers, control modules, or other processing devices, such as a processor 1404. Processor 1404 might be implemented using a general-purpose or special-purpose processing engine such as, for example, a microprocessor, controller, or other control logic. In the illustrated example, processor 1404 is connected to a bus 1402, although any communication medium can be used to facilitate interaction with other components of computing module 1400 or to communicate externally.

Computing module 1400 might also include one or more memory modules, simply referred to herein as main memory 1408. For example, preferably random access memory (RAM) or other dynamic memory, might be used for storing information and instructions to be executed by processor 1404. Main memory 1408 might also be used for storing temporary variables or other intermediate information during execution of instructions to be executed by processor 1404. Computing module 1400 might likewise include a read only memory ("ROM") or other static storage device coupled to bus 1402 for storing static information and instructions for processor 1404.

The computing module 1400 might also include one or more various forms of information storage mechanism 1410, which might include, for example, a media drive 1412 and a storage unit interface 1420. The media drive 1412 might include a drive or other mechanism to support fixed or removable storage media 1414. For example, a hard disk drive, a floppy disk drive, a magnetic tape drive, an optical disk drive, a CD or DVD drive (R or RW), or other removable or fixed media drive might be provided. Accordingly, storage media 1414 might include, for example, a hard disk, a floppy disk, magnetic tape, cartridge, optical disk, a CD or DVD, or other fixed or removable medium that is read by, written to or accessed by media drive 1412. As these examples illustrate, the storage media 1414 can include a computer usable storage medium having stored therein computer software or data.

In alternative embodiments, information storage mechanism 1410 might include other similar instrumentalities for allowing computer programs or other instructions or data to be loaded into computing module 1400. Such instrumentalities might include, for example, a fixed or removable storage unit 1422 and an interface 1420. Examples of such storage units 1422 and interfaces 1420 can include a program cartridge and cartridge interface, a removable memory (for example, a flash memory or other removable memory module) and memory slot, a PCMCIA slot and card, and other fixed or removable storage units 1422 and interfaces 1420 that allow software and data to be transferred from the storage unit 1422 to computing module 1400.

Computing module 1400 might also include a communications interface 1424. Communications interface 1424 might be used to allow software and data to be transferred between computing module 1400 and external devices. Examples of communications interface 1424 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 1424 might typically be carried on signals, which can be electronic, electromagnetic (which includes optical) or other signals capable of being exchanged by a given communications interface 1424. These signals might be provided to communications interface 1424 via a channel 1428. This channel 1428 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 1408, storage unit 1420, media 1414, and channel 1428. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 1400 to perform features or functions of the disclosed technology as discussed herein.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A process for preparing material for tracer ammunition, comprising the operations of:

receiving first particles of exothermic material of a first average size at a first ultrasonic processing station that includes an ultrasonic transducer;

applying ultrasonic energy to the particles by the first ultrasonic processing station to break down the received particles of exothermic material into reduced-size particles of a second average size that is smaller than the first average size;

transferring the reduced-size particles into one or more successive ultrasonic processing station, wherein at least one successive ultrasonic processing station applies ultrasonic energy to particles it receives to further reduce the average size of its received particles; and compacting a light producing material onto the exothermic material to form a tracer pellet.

2. The process of claim 1, further comprising the operations of mixing the first particles of exothermic material with a solvent prior to the application of ultrasonic energy to reduce the particle size.

3. The process of claim 1, further comprising compacting the exothermic material into a pellet under sufficient pressure to prevent the exothermic material from breaking up and ejecting from the tracer ammunition during combustion thereof.

4. The process of claim 3, wherein the tracer pellet comprises an exothermic layer capped by a luminescent layer.

5. The process of claim 4, further comprising providing a seal on the tracer pellet to form a sealed tracer pellet.

6. The process of claim 5, wherein the seal comprises an oxide layer.

7. The process of claim, 4 wherein the pellet is formed in a die or other form separate from the ammunition and loaded into a chamber in the ammunition after formation.

8. The process of claim, 4 wherein the tracer pellet is formed in a chamber of the ammunition by placing exothermic material and luminescent material into the chamber and compressing the exothermic material and luminescent material in place in the chamber.

9. The process of claim, 4 wherein the tracer pellet is formed to include an outer surface having a concave contour.

10. The process of claim, 4 wherein the tracer pellet is formed to include rear facing surface having a contour shaped such that the optical energy is emitted as a Lambertian or near Lambertian light source as a result of combustion of the tracer material.

11. The process of claim 4, wherein the tracer pellet is formed to include a rear facing surface having a contour shaped to confine an exit angle of the optical energy to a predetermined maximum angle.

12. The process of claim 4, wherein the tracer pellet is formed to include a surface contoured to reduce an axial normal area of the surface relative to a flat surface.

* * * * *